US011530901B2

(12) United States Patent
Brewer et al.

(10) Patent No.: US 11,530,901 B2
(45) Date of Patent: Dec. 20, 2022

(54) REFLEX SIGHT UTILIZING SHOCK ABSORPTION

(71) Applicant: Axial Innovation LLC, Spanish Fork, UT (US)

(72) Inventors: Coleby P. Brewer, Spanish Fork, UT (US); Brian D. Owens, Plano, TX (US)

(73) Assignee: Axial Innovation LLC, Spanish Fork, UT (US)

( * ) Notice: Subject to any disclaimer, the term of this patent is extended or adjusted under 35 U.S.C. 154(b) by 0 days.

(21) Appl. No.: 17/137,812

(22) Filed: Dec. 30, 2020

(65) Prior Publication Data

US 2021/0207928 A1 Jul. 8, 2021

Related U.S. Application Data

(60) Provisional application No. 62/956,947, filed on Jan. 3, 2020.

(51) Int. Cl.

| | |
|---|---|
| ***F41G 11/00*** | (2006.01) |
| ***F41G 1/30*** | (2006.01) |
| ***F41G 1/16*** | (2006.01) |
| ***F41G 1/06*** | (2006.01) |
| ***F41G 1/14*** | (2006.01) |

(52) U.S. Cl.

CPC ..... *F41G 11/002* (2013.01); *F41G 1/065* (2013.01); *F41G 1/14* (2013.01); *F41G 1/16* (2013.01); *F41G 1/30* (2013.01)

(58) Field of Classification Search

CPC ..... F41G 11/002; F41G 1/065; F41G 1/14; F41G 1/16; F41G 1/30; F41G 1/22

USPC ..... 42/111, 113, 143

See application file for complete search history.

(56) References Cited

U.S. PATENT DOCUMENTS

| | | | | |
|---|---|---|---|---|
| 8,215,050 | B2 | 7/2012 | Elpedes et al. | |
| 8,443,541 | B2 | 5/2013 | Elpedes et al. | |
| 8,966,805 | B2 * | 3/2015 | Koesler | F41G 1/345 42/111 |
| 9,010,012 | B2 | 4/2015 | Matthews et al. | |
| 9,823,044 | B1 * | 11/2017 | Cabrera | F41G 1/17 |
| 9,958,234 | B2 * | 5/2018 | Campean | F41G 1/30 |
| 10,139,197 | B1 * | 11/2018 | Horton | F41G 1/383 |
| 10,240,898 | B2 | 3/2019 | Crispin | |
| 10,907,932 | B2 * | 2/2021 | Curry | F41G 1/30 |
| 2015/0198415 | A1 * | 7/2015 | Campean | F41G 1/30 42/137 |
| 2016/0327366 | A1 * | 11/2016 | Campean | F41G 1/16 |
| 2018/0292168 | A1 | 10/2018 | Borrico | |
| 2019/0277600 | A1 * | 9/2019 | Larsson | F41G 1/345 |
| 2020/0200507 | A1 * | 6/2020 | Curry | F41G 1/30 |
| 2020/0232759 | A1 * | 7/2020 | York | F41G 1/30 |

(Continued)

*Primary Examiner* — John Cooper

(74) *Attorney, Agent, or Firm* — Goodhue, Coleman & Owens, P.C.

(57) ABSTRACT

An optical sight, system, and method for a firearm. The optical sight includes a housing including a base. A first support and a second support extend from the base. A top support extends between the first support and the second support. The top support extends over an optical element and includes a surface adjacent to the optical element. A second cross member defining one or more openings between the first cross member and the first and second supports. An optical element supported by said housing between said first support and said second support. A reticle is displayed on the optical element.

20 Claims, 15 Drawing Sheets

(56) References Cited

U.S. PATENT DOCUMENTS

| | | | | |
|---|---|---|---|---|
| 2021/0156645 | A1* | 5/2021 | Heath | F41G 11/001 |
| 2021/0156646 | A1* | 5/2021 | Schulte | F41G 1/16 |
| 2022/0026175 | A1* | 1/2022 | Chavez | F41G 1/30 |

* cited by examiner

1400

REFLEX SIGHT UTILIZING SHOCK ABSORPTION

BACKGROUND

Optical sights are utilized on firearms to ensure that the shooter is last and accurate when shooting at a specified target. Accurate shooting is important for the safety and well-being or the shooter as well as other individuals that may be proximate the shooter. Often the various components of the optical sight are quite delicate. As a result, it is important to protect the optical sight from impacts or shocks that may occur as the firearm is discharged, utilized in a dynamic environment, dropped, set down, stored, or so forth.

In addition, many existing optical sights have not improved to allow customization and configuration that many users have come to expect with their personal electronic devices. As a result, reticles, aiming systems, power conserving methods, modes, and other aspects of the optical sights may be preset and permanently established without the possibility of being updated, changed, or reconfigured.

SUMMARY

One embodiment includes a system, method, and optical sight for a firearm. The optical sight includes a housing including a base. A first support and a and a second support extend from the base. A top support extends between the first support and the second support. The top support extends over an optical element and includes a surface adjacent to the optical element. A second cross member defining one or more openings between the first cross member and the first and second supports. An optical element supported by said housing between said first support and said second support. A reticle is displayed on the optical element.

In alternative embodiments, the optical sight may include a reticle projected on the optical element. The side openings may define an isosceles trapezoid. The top opening in the top support may be a rounded rectangle. The top opening follows a curvature of the optical element including at least a lens below the top opening. The optical sight may be a reflex sight configured to be mounted to at least a handgun. The base includes a number of adjustments for one or more light sources projecting at least the reticle. The number of adjustments may be positioned below the side openings. The optical element may be an objective lens.

Another embodiment provides a method for configuring a reticle of an optical sight. A current configuration of the optical sight including the reticle is displayed. User input for configuring the reticle is received. The configuration of the optical sight is updated in response to the user input. The reticle is displayed within the optical sight. The base includes a number of adjustments for a light source In other embodiments, a number of radicals implemented by the optical sight are presented with the user input received from the number of radicals. The displaying, receiving, and updating may be performed by an electronic device in communication with the optical sight. The electronic device may execute an application to display the current configuration, receive user input, and update the configuration of the optical sight. The reticle may be projected as configured based on the user input. One or more light sources of the optical sight may project the reticle. One or more lenses or filters may display the reticle in response to light received from one or more light sources. The optical sight may be a reflex sight and the reticle includes at least a dot presented for aiming a weapon attached to the optical sight. The user input may include at least brightness, one or more colors, and configuration of the reticle. The user input and configuration of the reticle may be store in a memory of the optical sight. A menu of reticle configurations may be communicated to the user in response to the displaying the current configuration of the optical sight including the reticle. The one or more light sources may be reflected off of a micromirror array to generate the reticle. The micromirror array may be configured to display a plurality of reticle including colors and configurations in response to commands from the logic.

BRIEF DESCRIPTION OF THE DRAWINGS

Illustrative embodiments of the present invention are described in detail below with reference to the attached drawing figures, which a incorporated by reference herein and wherein.

DETAILED DESCRIPTION OF THE DRAWINGS

Figure 1:
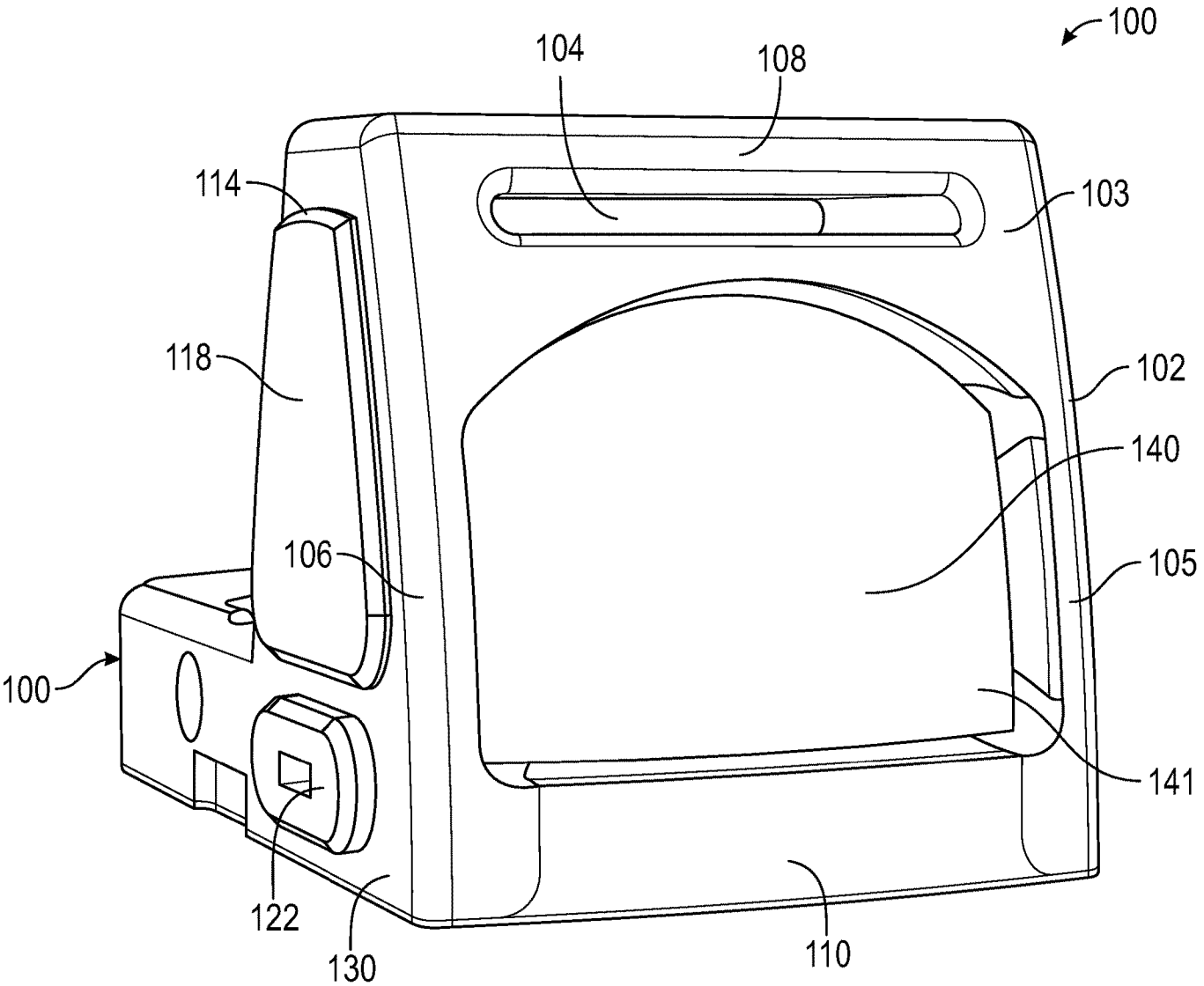
FIG. 1 is a perspective view of an optical sight in accordance with an illustrative embodiment.
Figure 2:
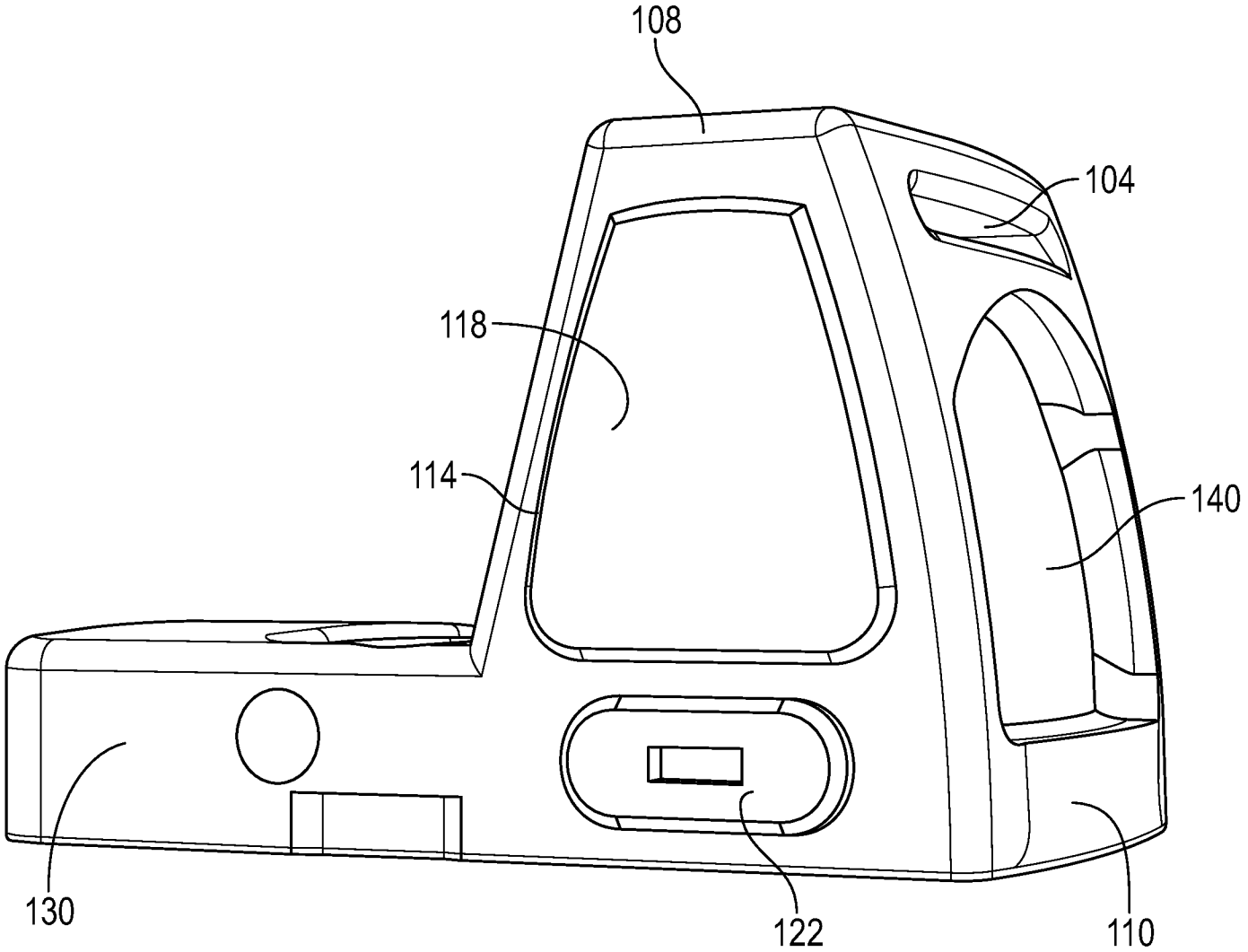
FIG. 2 is a pictorial representation of the optical sight of FIG. 1 in accordance with an illustrative embodiment.
Figure 3:
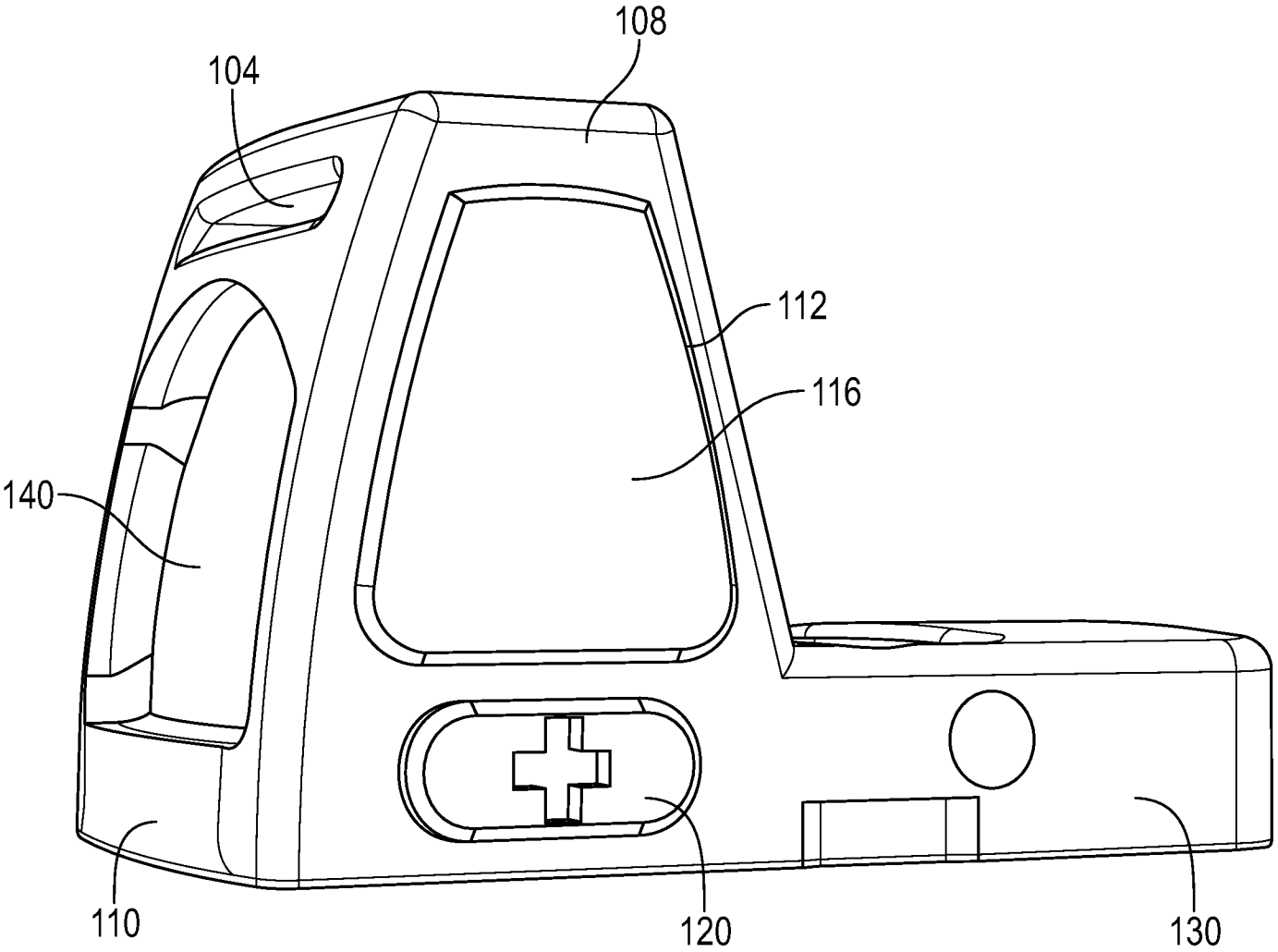
FIG. 3 is a pictorial representation of the optical sight of FIG. 1 in accordance with an illustrative embodiment.
Figure 4:
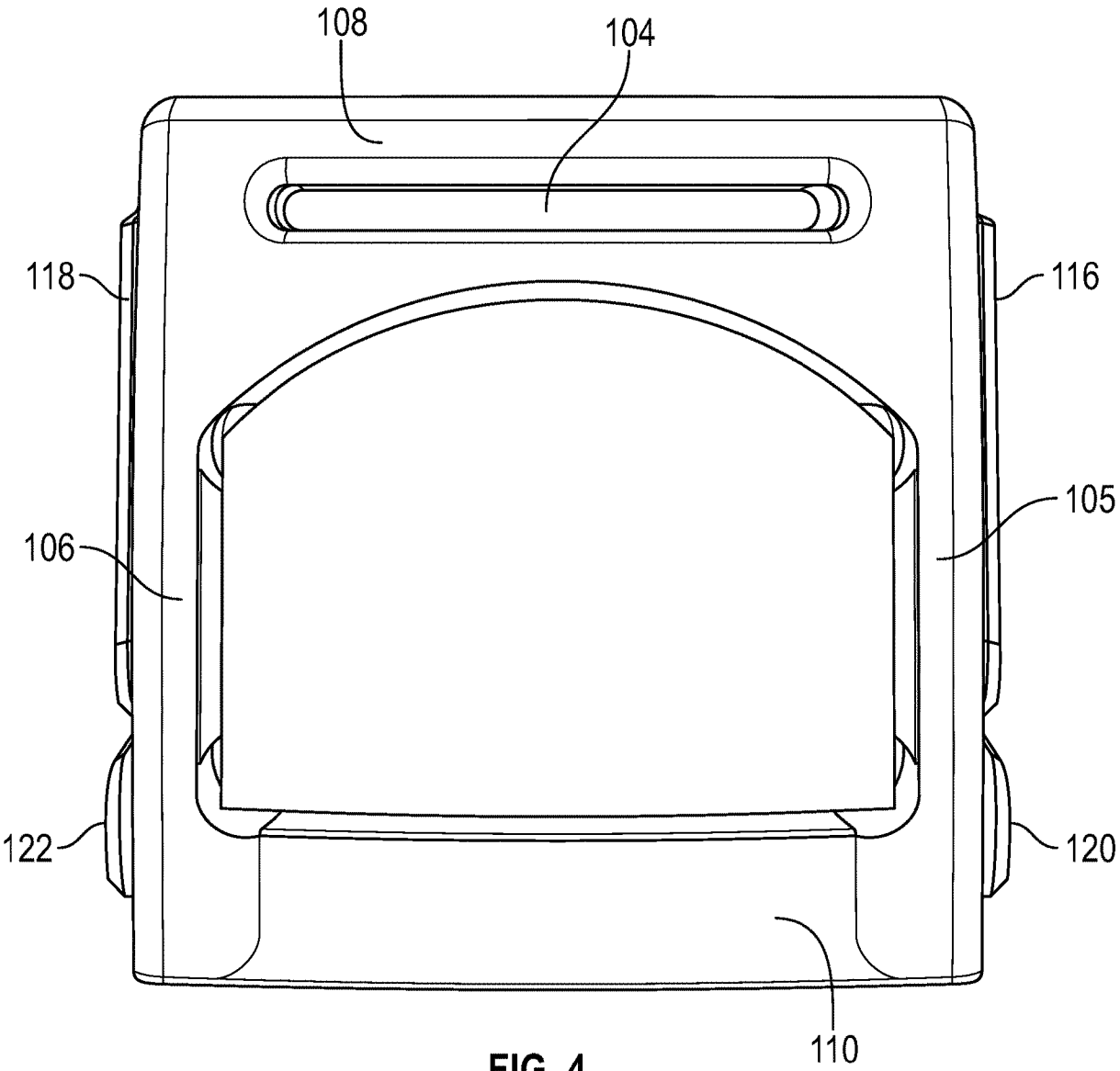
FIG. 4 is a pictorial representation of the optical sight of FIG. 1 in accordance with an illustrative embodiment.
Figure 5:
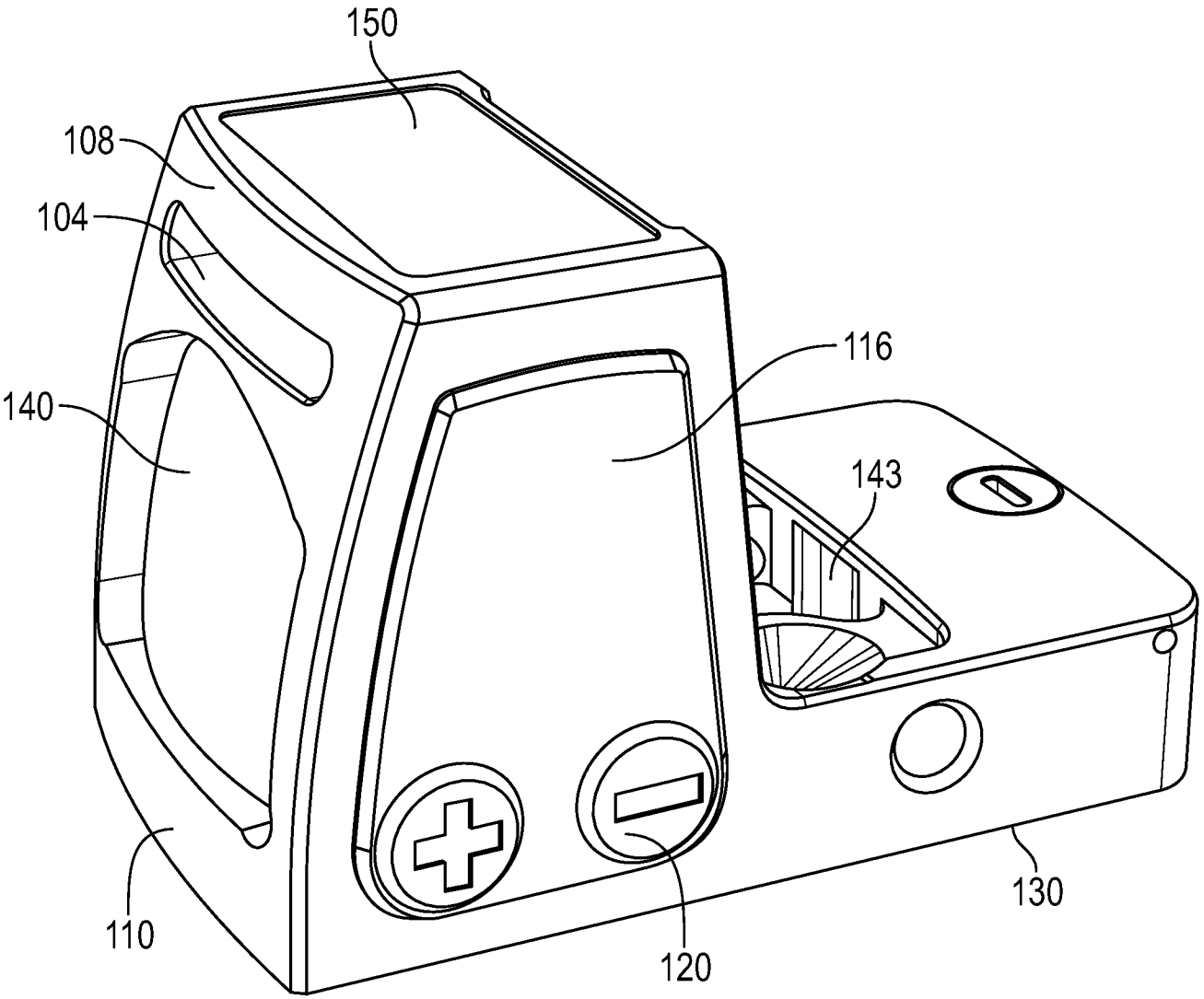
FIG. 5 is a pictorial representation of the optical sight of FIG. 1 in accordance with an illustrative embodiment.

The illustrative embodiments provide a system, method, and enhanced optical sight. The optical sight may be a reflex sight that may be utilized with firearms, weapons, or discharging devices. The optical sight may also be a holographic, telescopic, or other sighting device. The firearms may include handguns (e.g., semi-automatic, revolver, etc.), rifles, air guns, spring guns, tranquillizer guns, and so forth. The optical sight mar utilize any number of openings or cavities defined within the housing to perform shock absorption and minimize the forces imparted on the optics (e.g., lenses, etc.) during shooting, if the firearm and sight are dropped and so forth. The openings may also be referred to as cut-outs, windows, gaps, or spaces. In one embodiment, the openings may channel imparted forces away from the optics. The openings may be empty for air flow and liquid drainage. The openings may also include shock absorbing materials that absorb imparted forces to lessen the impact on the optical elements, such as lenses that are susceptible to cracking, breaking, or damage.

In one embodiment, the housing may define a top opening that translates forces imparted on a top portion (e.g., top support, cross member, connector, etc.) of the optical sight down through the edge or side supports of the housing (i.e. left and right, first and second). The top opening may lessen impact forces that are imparted on the optics/optical elements. For example, the top opening may divert the most potentially damaging forces to one or more lenses that may be imparted on the optical sight. A top portion of the housing may bend or deform to take the forces without damaging the electronics (e.g. logic, amplifiers, wiring, batteries, etc.), sensitive lenses, and other optics of the optical sight. On or more portions of the housing (e.g., top, sides, etc.) may incorporate a solar cell. The solar cells may have shock absorbing covers that may cover the optical sight when not being utilized or needed to further protect the optical sight and perform shock absorption. The housing may also define openings on the sides of the optical sight. The side openings may include shock absorbers that absorb impacts and other forces imparted on the optical sight or communicated within the optical sight. The shock absorbers may represent inserts that may be integrated within the top opening(s) or side openings. As a result, the shock absorbers may be added or removed as needed. In another embodiment, the shock absorbers may represent materials that are injected into the side openings during or after the manufacturing process.

The optical sight may also include a number of adjustment mechanisms (e.g., buttons, dials, switches, knobs, screws, etc.). The adjustment mechanisms or their covers may be formed from the same shock absorbing materials or distinct shock absorbing materials. In one embodiment, the adjustment mechanisms may be included on the opposing sides of a base of the optical sight. The adjustment mechanisms may also be included on a single side of the optical sight.

The optical sight may be generally square or rectangular shaped with rounded edges when viewed from the front (e.g., looking at the optics). Any number of other trapezoidal or rounded shapes and configurations are also expected. The supports of the housing that encompass the optics may be a triangular trapezoid. A base of the optical sight includes a small footprint sufficient to be mounted to the top of a firearm. The base (or other portion of the housing) may house the electronic components, such as one or more batteries, light sources, logic/hardware, or so forth. In one embodiment, the base may include a removable tray for easily swapping out the battery or batteries of the optical sight. The batteries may power the light source, hardware, and other components.

The housing of the optical sight may be milled, machined, molded, or otherwise formed from metal, such as titanium or aluminum. Similar, the openings may extend all of the way through the optical sight or through a portion of the sight. The housing may represent a single body construction or multiple components that may be secured together utilizing bolts, screws, rivets, tabs, welding, adhesives, or mechanical fasteners. The optical sight may attach in numerous ways. For example, on handguns the optical sight may be attached directly to the slide using screws. bolts, tabs, rods, or so forth. The optical sight may attach to rifles using a rail system, such as a picatinny rail attachment (e.g., the sight is attached to the rail using screws, and then the rail is attached to the gun/weapon/shooting system).

FIGS. 1-5 are a pictorial representation of an optical sight 100 in accordance with an illustrative embodiment. In one embodiment, the optical sight 100 is a reflex sight that displays a reticle or other aiming constructs. The reticle may be projected directly or indirectly (e.g., reflectors microarray of mirrors, mirrors, lenses, collimators, gratings, etc.) on to one or more lenses for communication/display to the eye of the user. The optical sight 100 may include a housing 102, an upper portion 103, a top opening 104, supports 105, 106, a top support 108, a bottom support 110, shock absorbers 116, 118, adjustments 120, 122, a base 130, optics 140, one or more lens 141, one or more light sources 143, and a solar cell.

The optical sight 100 is configured to be mounted, attached, integrated with, or manufactured as part of any number of firearms (e.g., handgun, rifle, black powder weapon, air pistol, etc.). The optical sight 100 is distinct in the way impacts or imparted forces applied to the housing 102 are distributed based on the structure, design, and functionality. The optical sight 100 is configured to handle shock and vibration from any number of processes (e.g., shooting the firearm associated with the optical sight 100, dropping the handgun and attached optical sight 100, hanging the optical sight 100 against structures or objects, applied forces, etc.) without damaging the optics 140.

The optics 140 are the most delicate portions of the optical sight 100. The optics 140 may include one or more lenses 141, light sources 143 (e.g., laser diodes, light emitting diodes, projectors, etc.), mirrors, folding mirrors, reflectors/smart reflectors, collimating reflectors, digital micromirror devices (DMD), sensors, display components, and so forth. For example, the lens 141 may represent an objective lens. If the optics 140 are damaged, the functionality and usefulness of the optical sight 100 may be extremely limited or nonexistent. As a result, protecting the optics 140 is extremely important. This is even more true where users may utilize the optical sight 100 in real life scenarios where firearm optics are crucial, such as police officers, public servants, security providers, military personnel, individuals requiring personal defense, and so forth. The illustrative embodiments are utilized to protect the optics 140 at the expense of the structure or aesthetics of the housing 102. For example, the housing 102 is shaped and structured to bend, scratch, or deform to protect the optics 140. In another embodiment, if a portion of the optics are damaged, such as lenses, the lenses may be replaced as a modular or replaceable unit.

As shown, the housing 102 defines the top opening 104. The top opening 104 may be a cavity or through hole defined within the upper portion 103 of the housing 102. In one embodiment, the top opening 104 is a rounded rectangular shape. The top opening 104 may extend above the entire optics 140 which may include one or more lenses. The top opening 104 may also extend substantially above the optics 140 (i.e., 70-100 percent of the width of the optics 140). In one embodiment, the top opening 104 may be 2 mm high. In other embodiments, the top opening 104 may vary between less than 1 min to approximately 5 mm. The width of the top opening 140 may be approximately 20 mm or may be just larger or smaller than the lens 141. In one embodiment, the top opening 104 may be wider than a width of the lens 141.

In other embodiments, the top opening 104 may represent an rectangle with oval shaped ends, a curved rectangular shape that follows an upper portion of the lens 141, a rectangle, a number of circular holes, a number of slits, or so forth. The top opening 104 may therefore be one or more openings position above the optics 140. The top opening 104 is positioned directly above the lens 141 so that forces imparted on the top support 108 are channeled to the sides of the housing 102 and down through supports 105, 106. As a result, the strongest and most potentially damaging forces are not communicated directly into the optics 140. For example, the top support 108 may bend or deform because of the top opening 104 rather than communicating forces directly into the optics 140 through the upper portion 103 of the housing 102. The width of the opening 112 may be mostly uniform or may vary. For example, the top opening 104 may have a wider width in the middle and narrower at the edges or conversely may have a narrower width in the middle and wider at the edges. In another embodiment, the top opening 104 may have a structure or framework within the top opening 104 to provide additional strength or rigidity. For example, a strand structure, triangles, or other supports or shapes may be integrated within the top opening 104.

The top opening 104 may be completely open (i.e. filled with air) or may be filled with a shock absorbing material, compressed gas, secondary inserts, or so forth. In one embodiment, the top opening 104 extends all of the way through the housing 102 to provide true shock absorption properties. The top opening 104 also serves as both a decoration, brand distinguisher, and ornamentation to distinguish the optical sight 100 from other optical sights. In another example, the top opening 104 may be filled with colorful, patterned, text-based, or marked inserts that allow the optical sight 100 to be customized and personalized by the user, group, corporation, or entity that owns the firearm and associated optical sight 100. The portion of the housing 102 associated with the top opening 104 may also be differently colored to provide additional ornamentation and draw attention to the top opening 104.

The optical sight 100 may also include openings 112, 114 integrated within the supports 105, 106. The supports 105, 106 are the sidewalls or extensions that extend upward from the bottom support 110 and base 130. The supports 105, 106 may also be referred to as a first support and second support, posts, or vertical extensions. The various components of the housing 102 may be formed (e.g., molded, milled, etc.) from a single piece of material or may be separately attached. The supports 105, 106 support and enclose the optics 140. The openings 112, 114 may also represent open air cavities, through holes, or partial cavities within the supports 105, 106. The openings 112, 114 are configured to receive the shock absorbers 116, 118. The shock absorbers 116, 118 may represent any number of dampening and shock absorbing materials (natural and synthetic), such as rubber, foam, plastic, polymers, and so forth. In one embodiment, the housing 102 may be titanium or military grade aluminum. The housing 102 may also be a combination of metals, polymers, plastics, and so forth.

The openings 112, 114 and the corresponding shock absorbers 116, 118 may also have any number of shapes or configurations. In one embodiment, the openings 112, 114 are triangular trapezoids or flattened triangles. The edges of the openings 112, 114 and shock absorbers 116, 118 may be rounded for enhanced ergonomics and to more easily add and remove the shock absorbers 116, 118 from the openings 112, 114. The shock absorbers 116, 118 may represent any number of custom selected materials and inserts utilized by the user for the optical sight 100. The shock absorbers 116, 118 may include any number of colors, designs, patterns, and materials configured for the needs of the user. The openings 104, 112, 114 may allow the optical sight 100 to be customized.

The openings 112, 114 and associated shock absorbers 116, 118 complement the top opening 104. As previously described, the top opening 104 ensures that forces imparted on the upper portion 103 of the housing 102 are channeled through the supports 105, 106 instead of into the optics 140 (i.e., one or more lens 141). The shock absorbers 116, 118 are positioned to absorb those forces as they are imparted into the supports 105, 106. As a result, the shock absorbers 116, 118 absorb and quell the shock, vibration and other forces rather than allowing them to be distributed unchecked within the optical sight 100 potentially damaging the optics 140 (and/or firearm).

The openings 112, 114 may alternatively be referred to as a left opening and a right opening, respectively. Similarly, the shock absorbers 116, 118 may alternatively be referred to as a left shock absorber and a right shock absorber, respectively. In one embodiment, the openings 112, 114 and the shock absorbers 116, 118 may represent an isosceles trapezium or isosceles trapezoid. The openings 112, 114 and the shock absorbers 116, 118 may have rounded corners to prevent the optical sight 100 from catching on or damaging users, items, or objects. The openings 112, 114 and the shock absorbers 116, 118 may mirror or follow side portions of the housing 102 defined by the supports 105, 106. In one embodiment, the openings 112, 114 may extend all of the way through supports 105, 106. In another embodiment, the openings 112, 114 may represent partial cutaways or recesses defined within the openings 112, 114 without defining through holes.

The shock absorbers 116, 118 absorb many of the forces communicated through the housing 102. As a result, the optics 140 are protected to increase the longevity and lifecycle of the optical sight 100. The shock absorbers 116, 118 may be updated based on usage, development of enhanced shock absorbing materials, for aesthetics, or so forth.

The base 130 may also include adjustments 120, 122. The base 130 or other portions of the optical sight 100 may also include other adjustment mechanisms, buttons, switches, dials, touch sensors, and so forth. The adjustments 120, 122 may be utilized to adjust the functionality and performance of the optics 140. For example, the adjustments 120, 122 may be utilized to configure, modify, program, and/or increase and decrease brightness, color, or settings of one or more displayed targeting components, such as a reticle, crosshairs, marks, indicators, or so forth. For example, the adjustments 120, 122 may be utilized to turn the optical sight on/off, or increase (e.g., adjustment 120) or decrease (e.g., adjustment 122) the brightness of the targeting components. In another embodiment, the optical sight 100 may include an automatic mode that may be set utilizing the adjustments 120, 122 that adjusts the reticle brightness (or other optical sight configurations) based on the ambient environmental conditions. The adjustments 120, 122 may be utilized to select or switch between different modes (e.g., manual, automatic, night mode, day mode, active threat, battery preservation, etc.), power on or off the optical sight 100, a reticle or reticle configuration, select reticle brightness/color, adjust windage and/or elevation, a button lock out mode or anti-adjustment mode (e.g., presents buttons or adjustments from being made).

The adjustments 120, 122 may also include a lockout mode to prevent accidental adjustments. In one embodiment, the adjustments 120, 122 represent buttons that may be pressed or otherwise selected. The adjustments 120, 122 interact with the electrical components (not shown) within the optical sight 100. For example, each time the adjustments 120, 122 are pressed, logical contacts, switches, or other electromechanical mechanisms may be activated to increase or decrease the brightness (or other associated functionality). The adjustments 120, 122 may also represent switches, dials, scroll wheels, or other adjustment mechanisms. The adjustments 120, 122 may be positioned below the openings 112, 114. For example, the adjustments 120, 122 may be symmetrically positioned beneath the openings 120, 122 and shock absorbers 116, 118. The adjustments 120, 122 may be formed from the same materials as the shock absorbers 116, 118. As a result, the adjustments 120, 122 themselves may also perform shock absorption and dampening within the housing 102. The housing 102 may also include additional openings and shock absorbers including any number of openings and shock absorbers (e.g., parallel or perpendicular to the base, dispersed circular openings, asymmetric shapes, etc.). The shock absorbers may house is the electrical, logical, and other components including the optics 140.

The adjustments 120, 122 may also be utilized to power on/off the optical sight 100, change the displayed or projected reticle/targeting mechanisms, change displayed colors, perform sight calibration (e.g., sighting in the reticle including elevation and windage adjustments), or otherwise configure or reconfigure the optical sight.

As shown, the supports 105, 106 may extend from a front portion of the base 130. A rear portion of the base 130 may include and/or house the battery, light source 143, logic, and other components of the optical sight 100. For example, the base 130 may define one or more compartments, separating structures, walls, or so forth for separating the various components. The housing 102 protects the various components of the optical sight 100 during normal usage (e.g., shooting, movement, jostling, etc.) and in the event of falls, drops, or so forth. In one embodiment, the shock absorbers 116, 118 are aligned symmetrically above the adjustments 120, 122 or within the supports 105, 106. In other embodiments, the openings 112, 114 and the associated shock absorbers 116, 118 may be positioned asymmetrically with regard to the adjustments 120, 122 and/or the supports 105, 106.

In another embodiment, the optical sight 100 may include an interface for changing one or more batteries of the optical sight 100 with or without removing the optical sight 100 from the associated firearm. For example, an inductive charger may be utilized with the optical sight 100 to recharge the battery. The charger may include a first set of coils/induction coil that serves as a primary transmitter and the optical sight 100 may include a secondary set of coils, rectifier, voltage regulator, that act as a receiver to convert the incoming signal into a usable current and voltage for recharging the battery. The inductive charger may interface with the optical sight 100 utilizing one or more batteries, connectors, attachment points, or so forth. The optical sight 100 may also include a port or interface for charging a rechargeable battery of the optical sight 100 for repeated usage.

In one embodiment, the base 130 of the optical sight 100 may connect to the firearm or accessories of the firearm utilizing any number of standard methods and attachment mechanisms, such as bolts, screws, mounts, rings, adapters, clamps, accessory rails, picatinny rail mounts, and so forth. The firearm may represent any number of single stack or double stack handguns, rifles, hybrid firearms, grenade launchers, rocket launchers, or so forth. As a result, the size of the optical sight 100 may vary based on the available footprint, width, and available space.

As noted, the base 130 may house a battery (not shown, rechargeable or non-rechargeable). The battery may represent a high-capacity battery, capacitor, fuel cell, or other energy storage device. The battery may be a one-time use battery or rechargeable battery. In one embodiment, the base 130 and associated electronics may include a micro-charging port. The micro-charging port may represent any number of waterproof interfaces for recharging the battery of the optical sight 100. The charging port may include an attached or removable cover that further protects the associated components from water, dirt, dust, and other foreign elements. The base 130 may also include an inductive charger.

The solar cell 150 may be utilized to charge the battery or power the optical sight 100 depending on the environmental conditions. For example, during daylight operation, the solar cell 150 may both power the optical sight and associated electronics (e.g., light sources, accelerometers, dynamic reflectors/micromirrors, logic, memory, etc.) and trickle charge the battery with excess capacity. In one embodiment, the solar cell 150 may operate the optical sight 100 in low light or artificial light conditions. The optical sight 100 may also utilize any number of kinetic and solar chargers similar to those utilized for watches and other small electronics. The kinetic charger may charge the battery of the optical sight 100 based on the two-dimensional or three-dimensional motion of the optical sight 100/firearm/user.

Shock is the effect of on the optical sight 100 imparted based on utilization of the firearm or other impact forces that are applied over a short time period. Because the optical sight 100 is attached to the firearm, the optical sight 100 will be exposed to significant forces that may be damaging to the optics 140, logic, or other components of the optical sight 100. The optical sight 100 is designed to be significantly more rugged than existing optical sights thereby increasing the usable lifespan and safe operation of the optical sight 100. Prolonged and reliable use is particularly important for the optical sight 100 based on its intended use as a protective, defensive, and lifesaving tool. The shock absorbers 116, 118 help absorb the energy from shock by decreasing the amplitude (strength) of the energy waves imparted or communicated through the optical sight 100 or changing the energy waves frequency. Energy absorption or dampening reduces or eliminates the adverse effects or damage to the optical sight 100. The shock absorbers 116, 118 may represent any number of shock absorbing/damping materials that perform well in a wide range of temperatures (e.g., heat/cold resistant) and environments. For example, the shock absorbers 116, 118 may represent a thermoset, polyether-based polyurethane material with visco-elastic properties. The shock absorbers 116, 118 my represent any number of standard or proprietary materials, such as one or more of rubber, synthetic rubber, plastic, polymers, foams, Sorbothane®, and other applicable materials, compounds, mixtures, or so forth. The shock absorbers 116, 118 may be colored, branded, or otherwise provide aesthetics that enhance the optical sight 100 or firearm.

Figure 6:
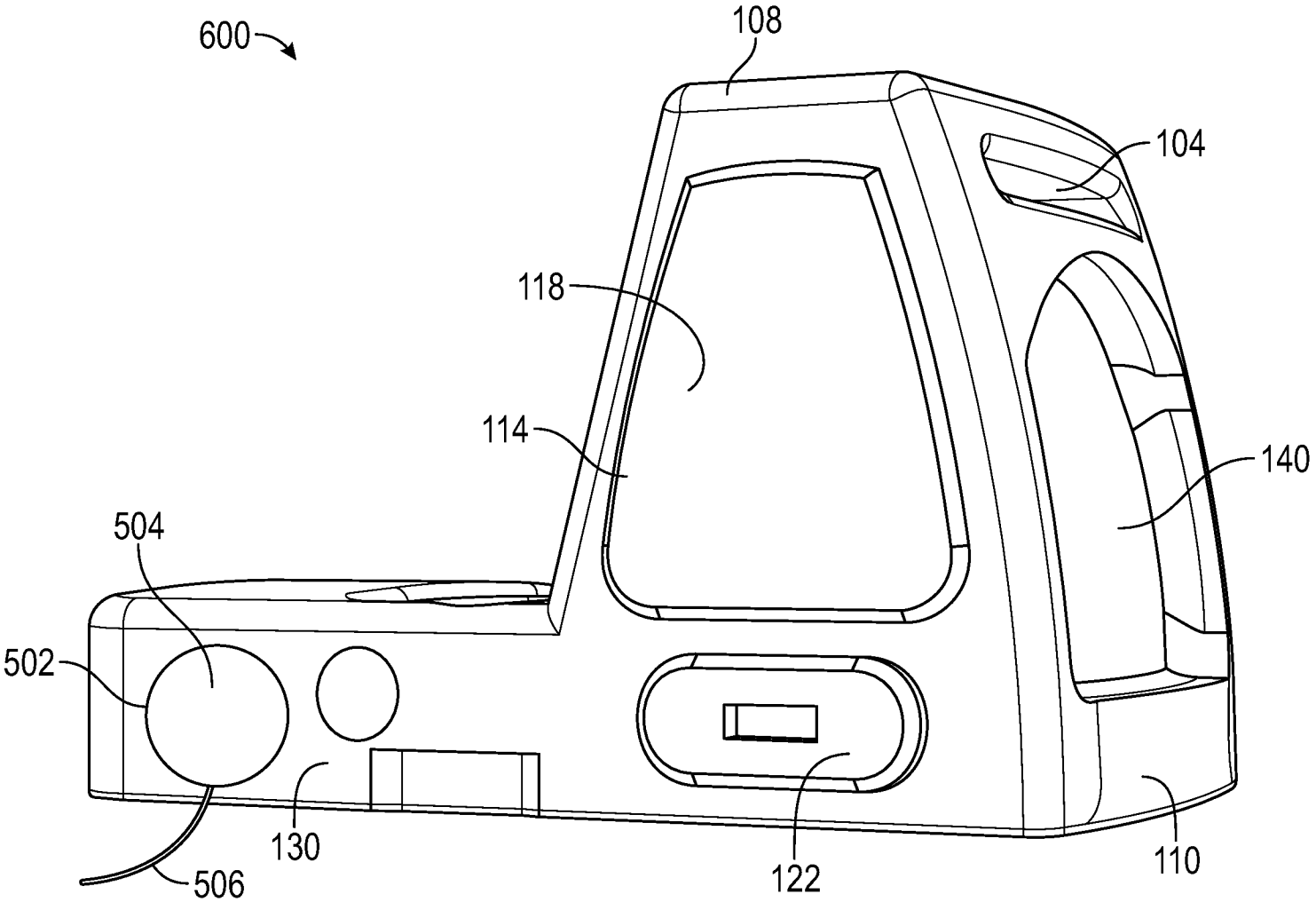
FIG. 6 is a pictorial representation of another embodiment of an optical sight in accordance with an illustrative embodiment.

FIG. 6 is a pictorial representation of another embodiment of an optical sight 600 in accordance with an illustrative embodiment. The optical sight 600 may include a switch 502. The switch 502 may represent a magnetic, contact, or inductive switch that is integrated with a portion of the optical sight 600, such as the base 130. The switch 502 interacts with an activator 504 that externally interacts with the switch 502.

The switch 502 may be a magnetic switch that interact with a magnet within the activator 504. For example, when the switch 502 is subject to a magnetic field from a magnet within the activator 504 the optical sight 600 opens a switch that prevents current and voltage from the battery from going to the internal electronics of the optical switch 600. As a result, the optical sight 600 is unable to power on when the activator 504 is positioned over, near, or proximate the switch 502.

The switch 502 is configured to activate or otherwise turn on the optical sight 600 when the activator 504 is removed from the base 130 or other portion of the optical sight 600 associated with the switch 502 (or multiple switches). The switch 502 ensures that the optical sight 600 preserves battery life when the optical sight 600 is not in use.

The activator 504 may be externally connected to a holster, carrying device, safe, user clothing, user's body, or so forth. In one embodiment, the activator 504 may be connected to a lanyard 506. The lanyard 506 may represent a miniature wire, cable, plastic strip, fabric, or other material that forms a tether between an object or user and the activator 504. As noted, the lanyard 506 may also represent a communication cable for communicating with a computing or communications device (e.g., laptop, smart phone, etc.). Another end of the lanyard 506 may include a clip, connector, snap, or other connection points that anchors the tether to a user or object, such as a holster, piece of clothing, or safe. As a gun with the optical sight 600 is removed from a position/location, the connected/anchored lanyard 506 pulls the activator 504 away from the switch 502 thereby activating the switch 502 to power on the optical sight 600. The lanyard 506 may be integrated with or attached to any portion of the activator 504. For example, the lanyard 506 may connect to an outside edge, external surface, internal portion, or other segment of the activator 504.

In another embodiment, the switch 502 may include an interface/contacts (e.g., circular contacts, pins, etc.) that interact with an interface, contacts, pins, or other portions of the activator 504. The switch 502, activator 504, and lanyard 506 may also be utilized to perform data communications with the optical sight 600. For example, software updates, reticle variations, user preferences, reticle selections, and other content may be added to the optical sight 600. Various types of communications (e.g., serial, parallel, proprietary, etc.) may be performed through the lanyard 506, switch 502 and activator 504. The physical and electrical connection between the switch 502 and the activator 504 keeps the optical sight 600 turned off or disengaged. Once the electrical connection between the switch 502 and the activator 504 is removed/broken, the optical sight 600 is turned on. For example, the battery is able to provide voltage and current to projection components, logic, memories, lights, optics, and so forth. The switch 502 operates to automatically turn on the optical sight 600 in response to the switch 502 and the activator 504 being disengaged, disconnected, or otherwise separated. The base 130 or other portion of the optical sight 600 may include any number of tabs, magnets, ridges, interfaces, or so forth to ensure that the switch 502 and the activator 504 are not inadvertently separated.

In other embodiments, the activator 504 may not include the lanyard 506. Instead, the activator 504 may be integrated with a holster, sale, or other transportation or carrying device. As a result, the switch 502 is activated as the activator 504 is removed from the switch 502.

In some embodiments, the base 130 (or other portion of the optical sight 600) may include an interface for ensuring that the activator 504 is effectively located and positioned proximate the switch 502. For example, the base 130 may define a small ridge around the periphery of the activator 504. In another example, the base 130 may also have a magnet that is attracted to the magnet of the activator 504 to ensure proper seating of the activator 504 in such a way that the switch 502 is opened or closed to prevent the optical sight 600 from being turned on when not being utilized.

The switch 502 ensures that the battery of the optical sight 600 is preserved for moments when it is critical that there be sufficient power to operate the optical sight. The switch 502 may be integrated into any portion of the base 130 including any of the sides or top of the base 130, the top support 108, the bottom support 110, the supports 105, 106, the shock absorbers 116, 118, or other portion of the optical sight 600.

Figure 7:
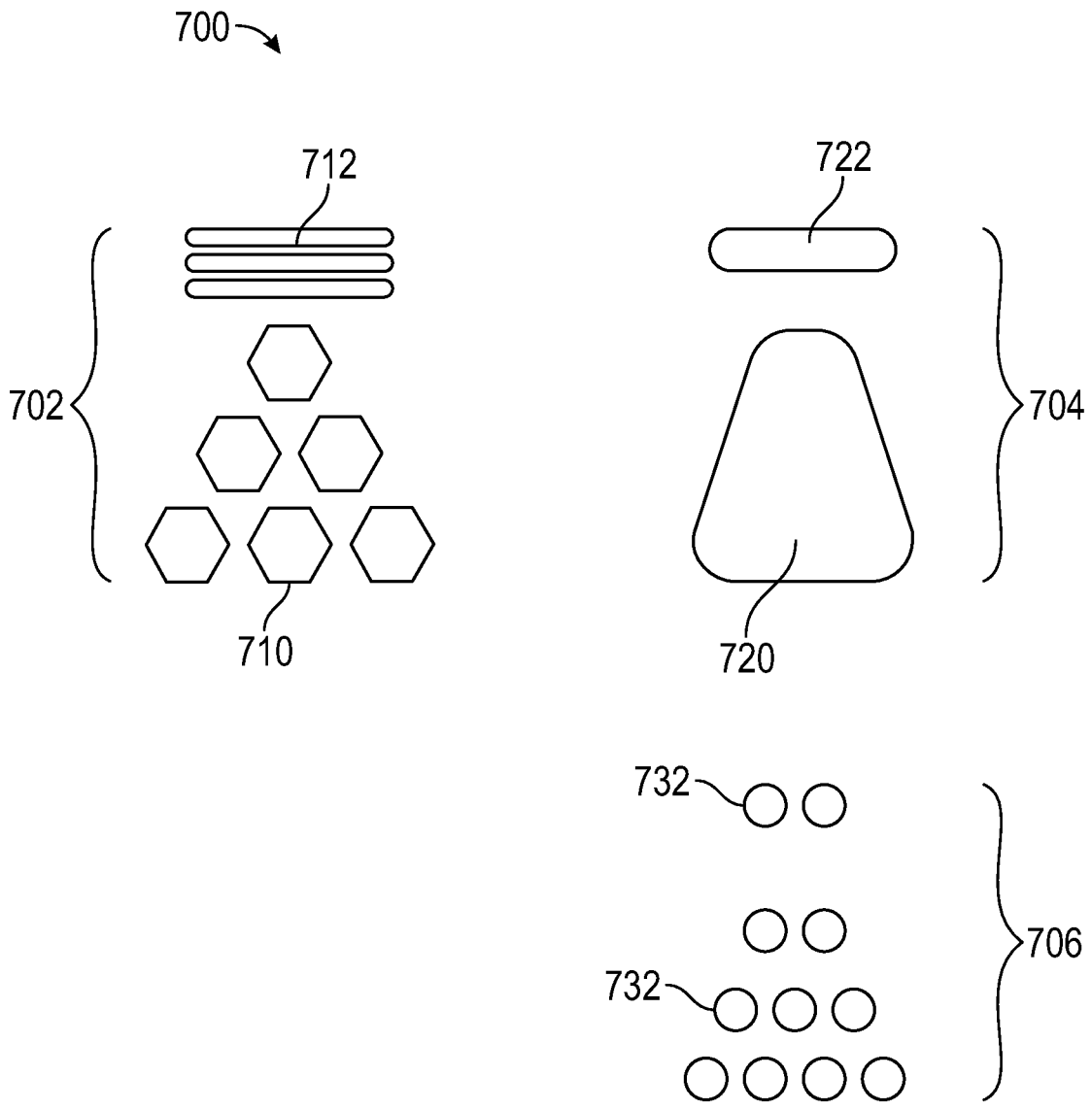
FIG. 7 is a pictorial representation of side openings in accordance with illustrative embodiments.

FIG. 7 is a pictorial representation of sight openings in accordance with illustrative embodiments. FIG. 7 shows three different sets of side openings 702, 704, 706 (altogether sets 700). As shown, the sets 700 may include openings of various shapes and sizes. The side openings 702, 704, 706 may also correspond to shock absorbers that may be inserted, injected, or otherwise integrated with the side openings 702, 704, 706. The various embodiments and openings illustrated in FIG. 7 may be rearranged, excluded, combined, merged, spaced differently, or otherwise utilized. The side openings 702, 704 706 may extend through sidewalls that are greater than 0.5 or 1 cm. As a result, the sets 700 present substantial openings within the optical sight that may also correspond to substantial vibration components. The various sizes, shapes, and configurations of side openings 702, 704, 706 (or portions thereof) may also be utilized for the top openings. For the top opening 104 described in FIG. 1, any number of circular, octagonal, elliptical, rectangular, rounded rectangles horizontal openings, rounded slits, or other shapes may be utilized as also shown in FIG. 7.

In one embodiment, the sight openings 702 may include hexagonal lower openings 710 positioned below upper openings 712 shown as lines of horizontal openings. The sight openings 502 may be positioned and spaced to absorb various forces imparted upon an optical sight from various directions. The hexagonal shape of the sight openings 702 may be replaced by any number of other sizes and shapes including circles, squares, rectangles, ellipses, arches, lines, asymmetric shapes, and so forth.

The sight openings 704 may include a larger lower opening 720 in the form of a rounded isosceles trapezoid that may be utilized alone or with an upper opening 722 shown as a horizontal opening. For example, the upper opening may be a rounded slit.

The sight openings 706 may include a number or circular openings defined within the frame of the optical sight for lower openings 730 and upper openings 732. The size and spacing of the circular openings may vary depending on the available footprint being utilized. As noted, the circles may be replaced by triangles, ellipses, squares, rectangles, slits/lines, pentagons, hexagons, octagons, or random shapes whose size, position, and orientation may vary in order to best observe forces communicated within the optical sight.

In one embodiment, the sight openings 700 may correspond to the shape and size of the supports 105, 106 and top support 108 of FIG. 1. The various embodiments differ from existing sights in that the sight openings 700 may be of a much more substantial depth than any ornamental cut-outs that have been previously utilized. In one embodiment, the sight openings 700 are defined within a shape that is approximately an isosceles trapezium or isosceles trapezoid. The size and shape of the various openings within the sight openings 700 may correspond to the size and shape of the supports and structure of the optical sight. For example, the side or lateral supports may take any number of shapes and sizes in which sight openings and the corresponding shock absorbers may be integrated.

Figure 8:
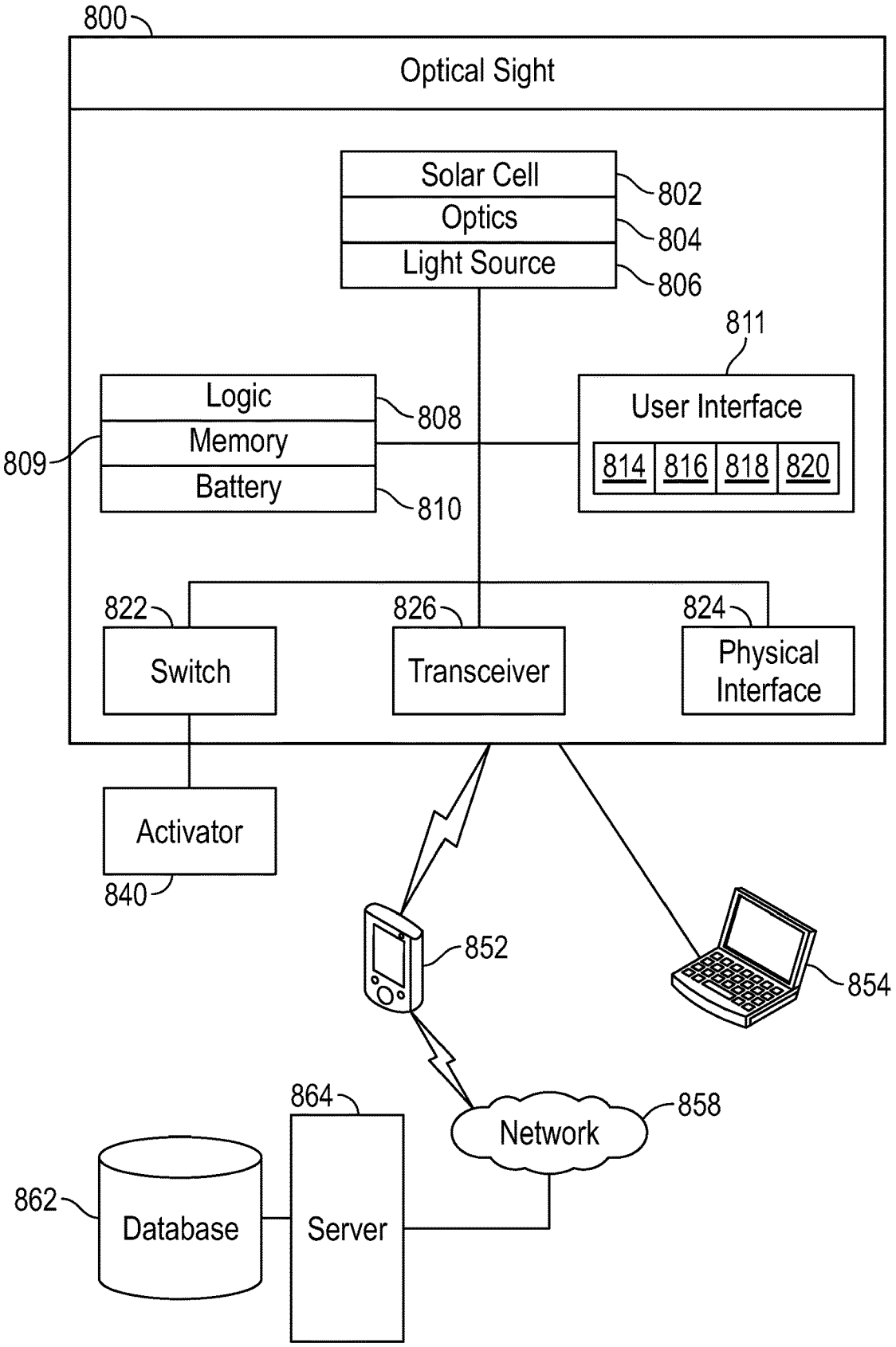
FIG. 8 is a block diagram of an optical sight in accordance with an illustrative embodiment.

FIG. 8 is a block diagram of optical sight 800 in accordance with an illustrative embodiment. The optical sight 800 may represent any number of reflex, holographic, telescopic sights, or other sights that are utilized with weapons or for monitoring. In one embodiment, the optical sight 800 may include a number of components and electronics, such as a solar cell 802, optics 804, a projector 806, logic 808, a memory 809, a battery 810, a user interface 811, sensors 818 (i.e., accelerometers, magnetometers, gyroscopes, touch sensors, etc.), a speaker 820, a switch 822, a physical interface 824, and a transceiver 826. The components of the optical sight 800 may communicate utilizing one or more wires, cables, traces, pins, busses, or other communications components. Fiber optics may also be utilized to communicate and emit light utilized by the optical sight 800. The switch 822 may further interact with the activator 840. The transceiver 826 may communicate with a mobile device 852 or computing device 854 directly or indirectly utilizing a wireless signal 856, a network 858, or a physical connection to the physical interface 824. The mobile device 852 and the computing device 854 may communicate with the database 862 and a server 864.

The solar cell 802 is a solar unit configured to power all or portions of the optical sight 800 based on sunlight, indoor light, ambient light, or so forth. In one embodiment, in full sunlight, the solar cell 802 may be sufficient to power the entire optical sight 800. The optical sight 800 may also include piezo electric generators, motion generators, fuel cells, or other miniaturized power or electricity generation or providing mechanisms. The solar cell 802 may provide voltage and currents directly to the various electronics of the optical sight 800 directly or through the battery 810. The optical sight 800 may also include any number of amplifiers, transformers, regulators, and other electronics for regulating and controlling power distribution and utilization within the optical sight 800.

In one embodiment, the light source 806 is the one or more light sources or projection components utilized by the optical sight 800 to display an aiming feature, such as a red dot, green dot, reticle, MIL-Dot, targeting/aiming features, or so forth. The light source 806 may project directly or indirectly on to one or more lenses of the optical sight 800. For example, the optical sight 800 may utilize an array of micromirrors (e.g., digital micromirror device, TI pico technology, etc.) to control the content that is reflected for display by the optical sight 800. In one embodiment, the light source 806 may project a dot or reticle that is reflected off of one or more mirrors and/or lenses for visualization by a user/shooter. For example, a MIL-Dot reticle may be used and refers to a standard, specific pattern of duplex crosshair reticles with four small 0.25 mil diameter dots placed along each axis. A milliradian (SI-symbol mrad, also abbreviated mil) is an SI derived unit for angular measurement which is defined as a thousand of a radian (i.e., 0.001 radian). The size of a dot (e.g., red, green, blue, etc.) may vary based on the user selection or application of the optical sight 800.

The light source 80 may represent one or more light emitting diodes, laser diodes, or other light sources that projects or otherwise communicates light (e.g., reticle, aiming content, etc.) onto the optics 804. The light source 806 may include any number of lenses, filters, caps, or other components that alter the color, shape, configuration or other portions of the aiming dot, reticle, targeting/aiming systems played to the user by the optical sight 800. In one example, a controllable light source or reflecting unit may be utilized to control the reticle, sight information, data, or so forth that is displayed by the optical sight 800.

The optics 804 may represent lenses (e.g., objective, diverging etc.), windows, mirrors, collimating reflectors, holographic gratings, and other components as are known in the art. In one embodiment, the optics 804 may include multiple lenses. The lenses may also seal in gases that are utilized to ensure clarity of the optics 804. In one embodiment, the optics 804 may represent various portions of a reflex sight. The term "reflex" may refer to the fact that the reticle or other aiming system is projected forward, from a point behind an objective lens and is then reflected off the back of the objective lens toward the user's eye (i.e. shooter). The optics 804 may include a single, double, or multiple lens. The light refracting properties of the optics 804 may allow for open eyes shooting that allows the user to visualize a target as well as the peripheral environment. As previously disclosed, the reticle, text, or other data projected or displayed by the optical sight 800 may vary based on configuration. The optical sight 800 uses any number of reflecting components to allow the user to see the reticle (and/or other data and information) and the field of view at the same tine. The optics 804 may reflect an image (e.g., reticle, aiming point, data, information, etc.) off of a lens or a slanted glass plate. The optical sight 800 uses a reticle and an infinite physician that stays in alignment with the optical sight and attached gun or weapon removing most of the parallax and other sighting issues found in many sighting devices. The optics 804 facilitate the quick and easy aiming of the associated weapon. As noted, the optical sight 800 may also be utilized with non-lethal weapons or targeting systems (e.g., tasers, beanbag guns, non-lethal rounds, electromagnetic or radiofrequency devices, etc.).

The illustrative embodiments may utilize openings within the housing of the optical sight 800 (see FIGS. 1-7) to better protect the optics and to absorb forces, shocks, and impacts that may otherwise damage the lenses, light sources, reflectors, mirrors, digital components, and other optical and electrical components of the optical sight 800.

The logic 808 is the data processing circuitry, components (e.g., transistors, gates, etc.) that implement algorithms, instructions, processes, or so forth. The logic 808 may represent hardware, software, firmware, and/or a combination of different data processing components, devices, systems, and equipment. In one embodiment, the logic 808 may include one or more processors. The processor may be circuitry or logic enabled to control execution of a set of instructions. The processor may be one or more microprocessors, digital signal processors, application-specific integrated circuits (ASIC), central processing units, or other devices suitable for controlling an electronic device including one or more hardware and software elements, executing software, instructions, programs, and applications, converting and processing signals and information, and performing other related tasks. The processor may be a single chip or integrated with other computing or communications elements.

The memory 809 is a hardware element, device, or recording media. configured to store data for subsequent retrieval or access at a later time. The memory 809 may be static or dynamic memory. The memory 809 may include a hard disk, random access memory, cache, removable media drive, mass storage, or configuration suitable as storage for data, instructions, and information. In one embodiment, the memory 809 and logic/processor may be integrated. The memory may use any type of volatile or non-volatile storage techniques and mediums.

The battery 810 may represent a rechargeable or single use battery. For example, the battery 810 may be a lithium-ion battery, graphene battery, or so forth. The battery 810 may also represent a fuel cell, Piezo electric generator, or other power generation component, device, or system. As previously described, the battery 810 may be easily accessed within the optical sight 800 utilizing a miniature screw bolt, interference fit, or other similar component. In one embodiment, the battery 810 may be stored within a housing, casing, or so forth for easily retrieving, exchanging, and/or replacing the battery 810. For example, a small knob may be utilized to extract a removable tray, cover, or attachment to replace the battery 810 by hand without requiring specialized tools.

The user interface 811 is the portion of the optical sight that receives user input, instructions, or feedback. The user interface 811 may include buttons 814 for adjusting the intensity of the light source 806. As shown, the buttons 814 are integrated in the base of the optical sight 800 (but are not included in the posts). The user interface 811 may include adjustments 816 for adjusting the windage (left and right) and elevation (up and down) of the displayed dot or reticle. The adjustments 816 may represent screws, dials, sliders, or other components for adjusting the windage and elevation of the displayed dot or reticle for sighting in the optical sight 800. In another embodiment, the adjustments 816 may represent buttons that may be pressed to make minute adjustments to the windage or elevation.

The user interface 811 may also include buttons or adjustment mechanisms for adjusting the size, shape, or configuration of the reticle. For example, the color of the reticle or dot may be changed from red to green, in another example, the line size of the reticle may be changed. In another example, the shape of the reticle may be changed.

The optical sight 800 may include am number of computing and telecommunications components, devices or elements which may include busses, motherboards, circuits, ports, interfaces, cards, converters, adapters, connections, transceivers, displays, antennas, and other similar components.

The sensors 818 may include any number of accelerometers, gyroscopes, magnetometers, global positioning systems, microphones, touch sensors, thermometers, barometers, humidity sensors, range finder, wind sensor, or so forth. The sensors 818 may act as stand-alone components or may be integrated with the user interface 811, logic 808, physical interface 824, or other components of the optical sight 800. The sensors 818 may be utilized to interact with the user, environment, gun/weapon/system, or other devices. In one embodiment, the sensors 818 may include inertial sensors or other sensors that measure acceleration, angular rates of change, velocity, impacts/shocks, and so forth. For example, inertial sensors may include an accelerometer, a gyro sensor or gyrometer, a magnetometer, a potentiometer, or other type of inertial sensor. The accelerometer may represent single-axis or multi axis models. The accelerometer may represent microelectromechanical systems (MEMS) and/or sensors. The accelerometer (or alternatively magnetometer or accelerometer) may detect the position and motion of the optical sight/weapon as well as relative position to the user. The inertial sensors may detect deliberate movements for controlling device functions (e.g., activating the optical sight, powering own the optical sight, changing reticle configuration, etc.). Any number of motions or activities detected by the sensors 818 may be associated with different actions performed by the logic 808 of the optical sight 800.

The sensors 818 may also include optical sensors. The optical sensors may be utilized to detect user biometrics, ambient light, and so forth. The other sensors 818 may be utilized to detect actions, such as an attached weapon being fired, the gun/optical sight 800 being dropped, or other relevant events. In one embodiment, the user interface 811 may include a speaker 820 for providing relevant information to the user regarding the status, configuration, or other optical sight information. For example, the speaker 820 may verbally indicate the battery status, zero/sight status, reticle selection/configuration, and so forth. In one embodiment, the logic 808 may implement a smart assistant to automatically change the reticle, mode, or other configuration of the optical sight 800 through a microphone, speaker, or light source 806. As previously noted, the optical sight 800 may also display text, information, and other data sensed by the optical sight 800 or an interconnected device. For example, shots fired, temperature, humidity, distances, reticle configuration/options, and so forth may be determined by the sensors 818 and displayed or otherwise communicated to the user.

The transceiver 826 is a component comprising both a transmitter and receiver which may be combined and share common circuitry on a single housing. The transceiver 826 may communicate utilize Bluetooth, Wi-Fi, ZigBee, near field communications, wireless USB, infrared, mobile body area networks, ultra-wideband communications, or other radio frequency standards, networks, protocols, or communications.

The physical interface 824 may include any number of components and devices for physically interacting with the optical sight. In one embodiment, the physical interface 824 may include any number of buttons, switches, touchscreens, screws, touch/capacitive sensors, and dials for adjusting the performance of the optical sight, such as light intensity, reticle size (e.g., MOA), shape, color, and/or configuration, power on/off settings (e.g., wake, sleep, hibernate, etc.), power conservation, sight adjustment (e.g., windage-left and right, elevation-up and down, etc.).

In another embodiment, the physical interface 824 may include one or more ports for connecting directly to a wireless device, computing device, or so forth. For example, the physical interface 824 may include a small port, such as a micro-USB, mini USB, USB-C, thunderbolt, serial interface, parallel interface, or other developing interfaces and ports. The user may utilize the port of the physical interface 824 to update the software, settings, parameters, configuration, or other functions and performance of the optical sight 800.

The switch 822 is a switching device that may be utilized to turn the optical sight 800 on or off. Alternatively, the switch 822 may move the optical sight 800 between modes, such as a sleep mode and an active/full power mode. During the sleep mode no power or very little power is utilized by the battery 810. In the active/full power mode the optical sight 800 is fully powered. In one embodiment, the activator 840 is detected, sensed, or connected to by the switch 822. The activator 840 may represent any number of magnetic, contact, or other components that interacts with switch 822. The activator 840 may be held in place by magnets, and interference fit, tabs, a port, ridges, or so forth.

In one embodiment, the switch 822 works with one or more components (e.g., logic 808 battery 810, etc.) to change the rower setting or mode of the optical sight 800 based on the presence or absence of the activator 840 proximate the switch 822. As previously described, the switch 822 and the activator 840 may operate based on proximity, physical contact, electrical interaction, magnetic field interaction, wireless interaction, or so forth. In one example, the switch 822 may power on the optical sight 800 in response to the activator 840 being removed from contact with or proximity to the switch 822. Alternatively, the opposite may be true in that the optical sight 800 is powered on in response to the activator 840 being placed in contact or proximate the switch 822. As previously noted, the activator 840 may be attached to or integrated with a storage device, such as a holster, safe, holder, clothing, vehicle, furniture, or so forth.

The optical sight 800 may be configured to communicate directly or indirectly with any number of electronic devices, such as the wireless device 852, the laptop 854, or the server 860 forth. The optical sight 800 may also be configured to communicate with electronic gun/weapons, computers, safety systems, tablets, smart devices, or so forth. For example, the optical sight 800 may communicate with the wireless device 852 utilizing a wireless signal 851. In another example, the optical sight 800 may communicate with the laptop 854 utilizing a wired connection 853 (e.g., USB to micro-USB cord, etc.) or connection through the activator 840 and switch 822. The optical sight 800 may also communicate with the wireless device 852 and the laptop 854 through the network 858. The wireless device 852, the laptop 854, and/or the server 864 may be configured to interact with the transceiver 826, memory 809 the logic 808, and other components of the optical sight 800 utilizing a program, mobile application, software interface, portal, website, or so forth. A portal may be a website that functions as a central point of access to information on the Internet or an intranet. The portal may be accessed from any computing or communications system or device enabled to communicate through a network connection.

The server 864 and associated database 862 may be utilized to program or update the optical sight 800. Updates to the software, firmware, logic 808, memory 809, or other components of the optical sight may be performed automatically based on user preferences, selectively/manually, or based on other criteria, factors, settings, parameters, conditions, or so forth. The wireless device 852 and the laptop 854 may also access information, data, or settings, from the server 864 and/or database 862 through one or more networks, such as the network 858. Updates to the optical sight 800 may be made directly utilizing the optical sight 800, such as the adjustment 816, or may be made remotely through the wireless device 852 and the laptop 854 or other devices.

Figure 9:
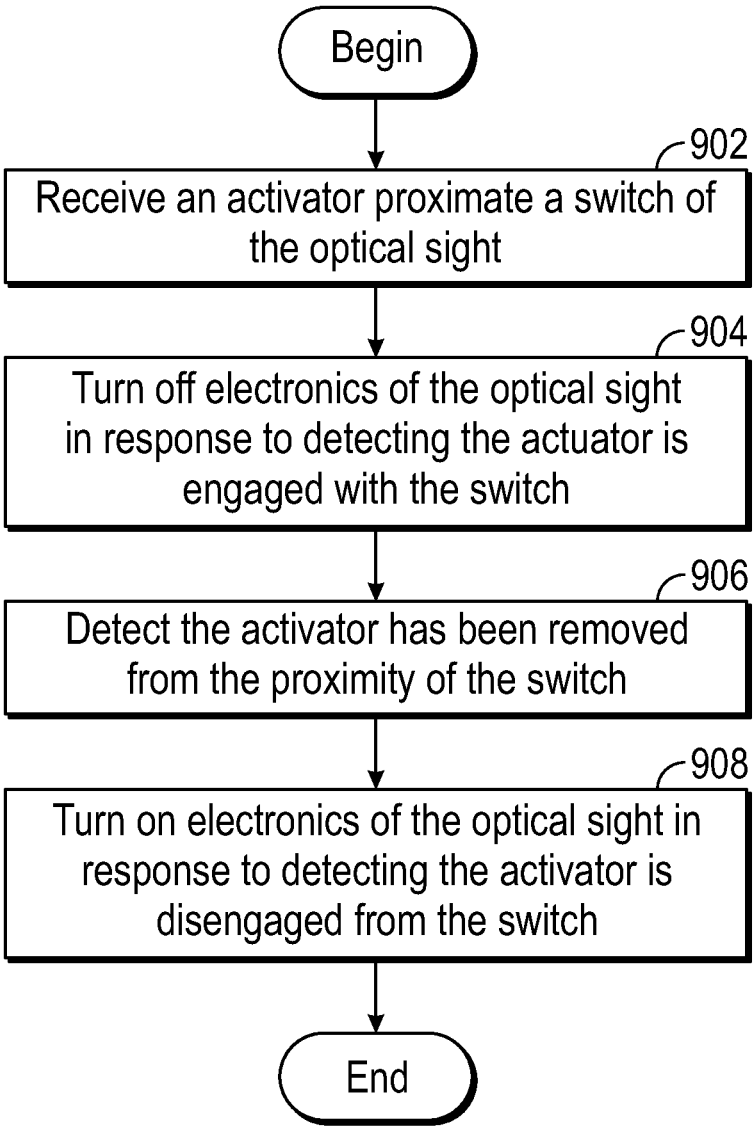
FIG. 9 is a flowchart of a process for activating the optical sight in accordance with an illustrative embodiment.

FIG. 9 is a flowchart of process for activating the optical sight in accordance with an illustrative embodiment. The process of FIG. 5 maybe implemented by an optical sight, such as those shown in FIGS. 1-6. The process may begin by receiving an activator proximate a switch of the optical sight (step 902). The optical sight may detect the proximity of the switch and the activator during step 902. For example, the optical sight may detect the activator utilizing physical contact, magnetic interactions, or other interactions that may engage the switch. The user may position the activator directly by hand, by moving or positioning the handgun and associated optical sight, or through any number of other actions. For example, the activator may be placed proximate the switch based on the handgun and optical sight being holstered, placed in a safe, docked with an object, or otherwise safely stored. In one embodiment, the activator is anchored, connected with, or attached to the user, a user's clothing, a holster, a safe, a vehicle, furniture, or other objects directly or indirectly. For example, the activator may be connected to the user or any number of objects utilizing a tether (e.g., wire, plastic, string, fabric, leather, strap, etc.).

Next, the optical sight turns off electronics of the optical sight in response to detecting the activator is engaged with the switch (step 904). During step 904, the optical sight may disengage all or a portion of the electronics the optical sight to prevent unwanted battery drain or power usage. For example, an open or closed connections through the switch may be utilized to ensure that the battery is not drawing power while the activator is proximate the switch. For example, the all or portions of the projector, light sources, and logic of the optical sight may be turned off. In one embodiment, a solar cell of the optical sight may be still connected to the battery or charging components to ensure that the optical sight is able to remain or be charged. The optical sight may also configure itself to eliminate or minimize parasitic currents or voltages that may deplete the battery over time.

Next, the optical sight detects the activator has been removed from the proximity of the switch (step 906). The activator may be detected based on a physical connection, magnetic interaction, wireless interaction (e.g., inductive, magnetic, radio frequency identification, etc.). In one embodiment, the activator may be required to move a specified distance from the switch to detect removal.

Next, the optical sight turns on electronics of the optical sight in response to detecting the activator is disengaged from the switch (step 908). The optical sight is turned on for immediate utilization. For example, projection components of the reflex sight may project the applicable reticle. As previously noted, the switch may be engaged to power on the optical sight in response to removing the activator. Removal of the actuator from the switch ensures that the optical sight and corresponding handgun/weapon are ready for immediate utilization. The optical sight is automatically turned on without requiring user interaction, such as turning on a switch, pressing a button, or otherwise performing a power up process.

The activator and switch of the optical sight provide an enhanced function for ensuring that the batten life of the optical sight is ready when needed. For example, the optical sight may be turned on for utilization with the handgun once the optical sight is removed from a holster or safe that the activator is integrated with or attached to. The optical sight may also use any number of other sensor readings or fail safes to turn on/off the optical sight to preserve battery life. The optical sight may also have a manual override function to ensure that the optical sight does not go to sleep/is not powered off when needed.

Figure 10:
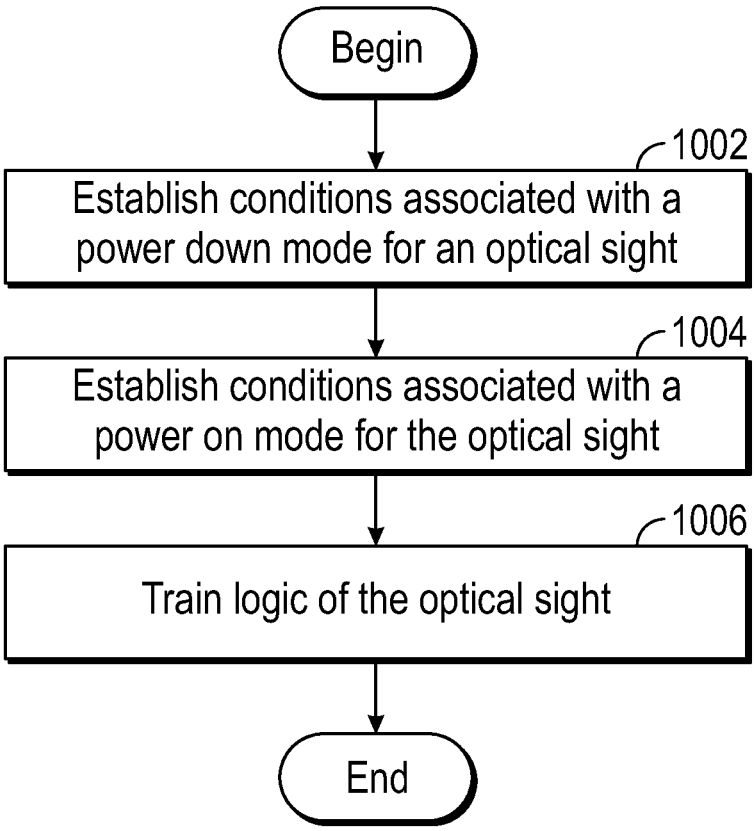
FIG. 10 is a flowchart of a process for establishing conditions for powering down the optical sight in accordance with an illustrative embodiment.

FIG. 10 is a flowchart of a process for establishing conditions for powering down the optical sight in accordance with an illustrative embodiment. The process of FIG. 10 may be performed before or after the optical sight is attached to the handgun or applicable weapon. The user may interact with the optical sight utilizing a user interface, such as buttons, dials, switches, soft buttons, or so forth. The user may also interact with the optical sight utilizing one or more external electronic devices, such as a smart phone executing a mobile application configured to interact, configure, program, or update the optical sight. The external electronic devices may communicate through a physical connection or wireless connection with the optical sight. The process of FIG. 10 may also be utilized to preserve the battery life and ensure that the optical sight is turned on and off at appropriate times.

The process may begin by establishing conditions associated with the powered down mode for an optical sight (step 1002). The conditions may include a position, orientation, motion, status (e.g., holstered, stored, etc.), time of day, and/or location of the optical sight. Any number of other factors, conditions, or parameters that may be sensed, measured, or determined by the optical sight or devices in communication with the optical sight may also be utilized. The optical sight may utilize one or more gyroscopes, magnetometers, accelerometers, touch sensors, proximity sensors, switches, activators, and other sensors or components to determine the position, orientation, location, and usage status of the optical sight during steps 1002-1006. Gravity activated switches, kinetic switches, or piezo electric devices may also be utilized to power off and on the optical sight. During the no power mode, the sensors required to activate the optical sight may draw minimal power are operated. The power down mode may also be referred to as a sleep mode or a hibernation mode because portions of the optical sight may continue to function in order to detect the optical sight is in use or not in use. For example, the optical sight may receive information that when the optical sight and corresponding firearm is stowed vertically in a holster, the optical sight is in the power down mode. In one embodiment, the optical sight may go to sleep if oriented in a particular position for a specified period of time (e.g., 15 minutes on a table, mount, vehicle, etc.). For example, if the optical sight is vertically holstered for 10 minutes the optical sight may go to sleep. One or more accelerometers, gyroscopes, magnetometers, and/or switches may also be utilized to activate and deactivate the optical sight.

Next, the optical sight establishes conditions associated with a power on mode for the optical sight (step 1004). As previously noted, the conditions may include a position, orientation, motion, status, time of day, and/or location of the optical sight. For example, a sudden motion of the optical sight, such as a drawing motion of the firearm/optical sight may power on the optical sight. In another example, horizontal positioning of the optical sight associated with a firing position may activate the optical sight. Motion of the optical sight activates the optical sight for immediate utilization faster than the human reaction time to begin utilizing the optical sight. For example, the optical sight may immediately activate the light source and reticle configuration as the optical sight is being drawn so that as the user begins to use the optical sight to aim or obtain a sight picture the reticle is already being displayed/reflected.

Next, the optical sight trains logic of the optical sight (step 1006). Step 1006 may be performed independently or as part of the process of step 1002 and 1004. During step 1006, the user may move the optical sight and associated handgun to establish the conditions under which the optical sight is turned off or turned on. In one embodiment, the user may train the optical sight by utilizing various positions, locations, motions, or so forth. For example, the user may place the handgun and optical sight in various positions and then associate the position with the power on or the power down mode. The optical sight may have an override button for overwriting the current mode regardless of conditions or training. For example, button, switch, or sensor may be utilized to automatically turn the optical sight on or off. A touch sensor associated with the optical sight may be utilized to turn the optical sight on or off. In addition, one or more timers may be utilized to automatically put the optical sight into the power down mode in response to the optical sight remaining unmoved for a specific period of time.

Figure 11:
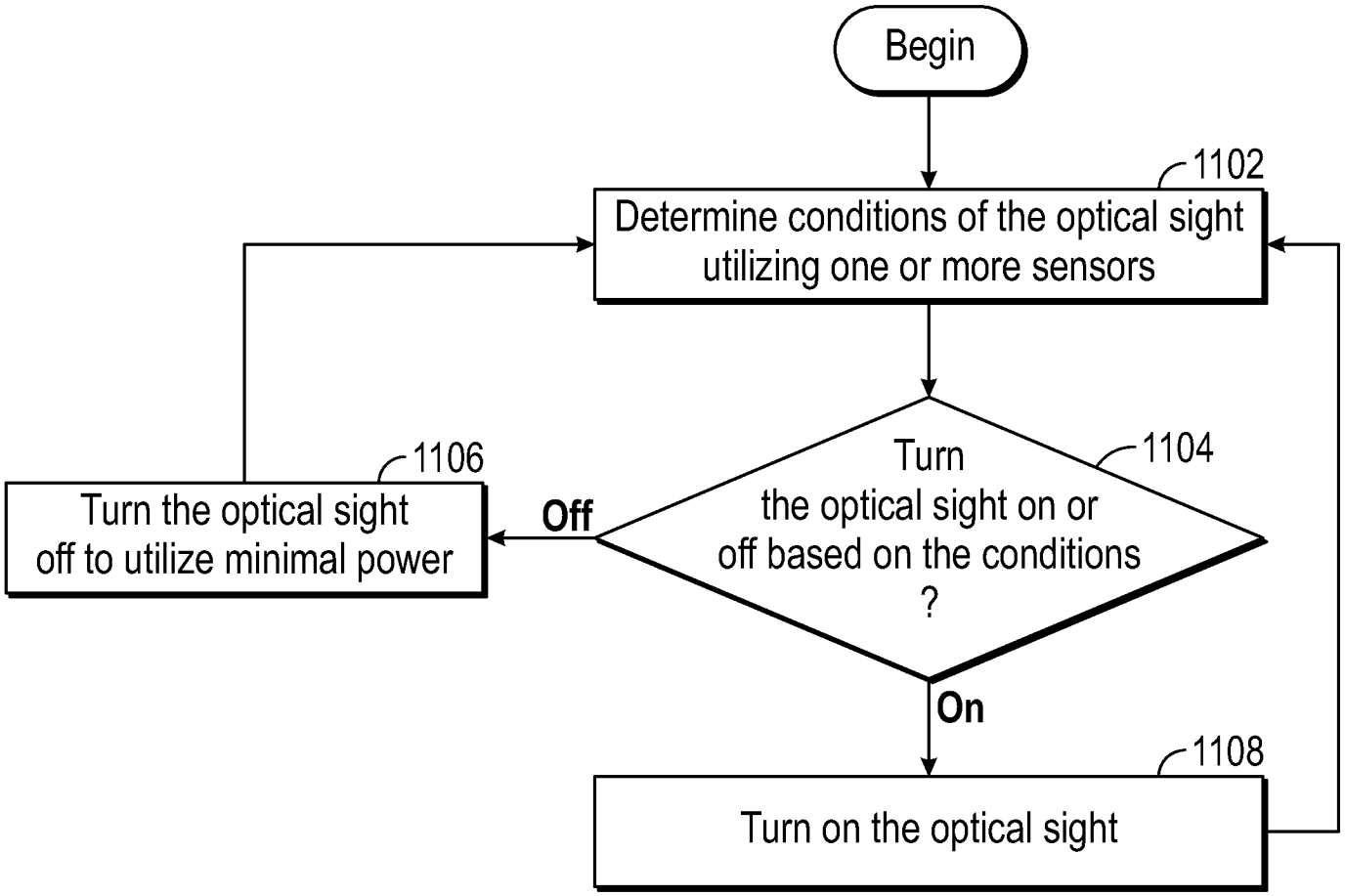
FIG. 11 is flowchart of a process for turning on or off the optical sight in accordance with an illustrative embodiment.

FIG. 11 is flowchart of a process for turning on or off the optical sight in accordance with an illustrative embodiment. The logic, sensors, memory, solar cell, and other portions of the optical sight may be utilized to perform the process of FIG. 11. The process of FIG. 11 may begin by determining conditions of the optical sight utilizing one or more sensors (step 1102). Any number of sensors of the optical sight may be utilized to determine the conditions. In some embodiments, the optical sight may include sensors that are not required to be actively powered to determine the conditions. For example, a gravity activated switch may determine when the optical sight is moved without drawing power from the battery of the optical sight.

Next, the optical sight determines whether to turn optical sight on or off based on the conditions (step 1104). The optical sight may utilize the condition, information, data, values, parameters, settings, training, factors, and other information determined during FIG. 10.

If the optical sight determines the conditions indicate the optical sight should be turned off during step 1104, the optical sight turns itself off to utilize minimal power (step 1106). During step 1106, the optical sight may be powered down or enter a sleep, rest, hibernation, or standby mode where power utilization is minimized for the optical sight to preserve battery life. In one embodiment, the optical sight may be powered only by a solar cell when the optical sight is powered down. Next, the optical sight returns to determine whether to turn itself on or off based on the conditions (step 1104). Turning off the optical sight may be associated with conditions or times when the optical sight is holstered, stored, transported, temporarily lost, or so forth.

If the optical sight determines the conditions indicate the optical sight should be turned on during step 1104 the optical sight turns itself on (step 1108). The optical sight is powered on for utilization of the optical sight and associated firearm or potential utilization. Weapons are infrequently used by most users and as a result the battery of the optical sight needs to be preserved for times when it is required including training, practice, self-defense and protection, law enforcement, military operations, and other necessary utilization. The optical sight may be turned on the process of being drawn or retrieved for utilization. As a result, the optical sight is ready to help the user obtain a sight picture, acquire a target, or otherwise be used.

Figure 12:
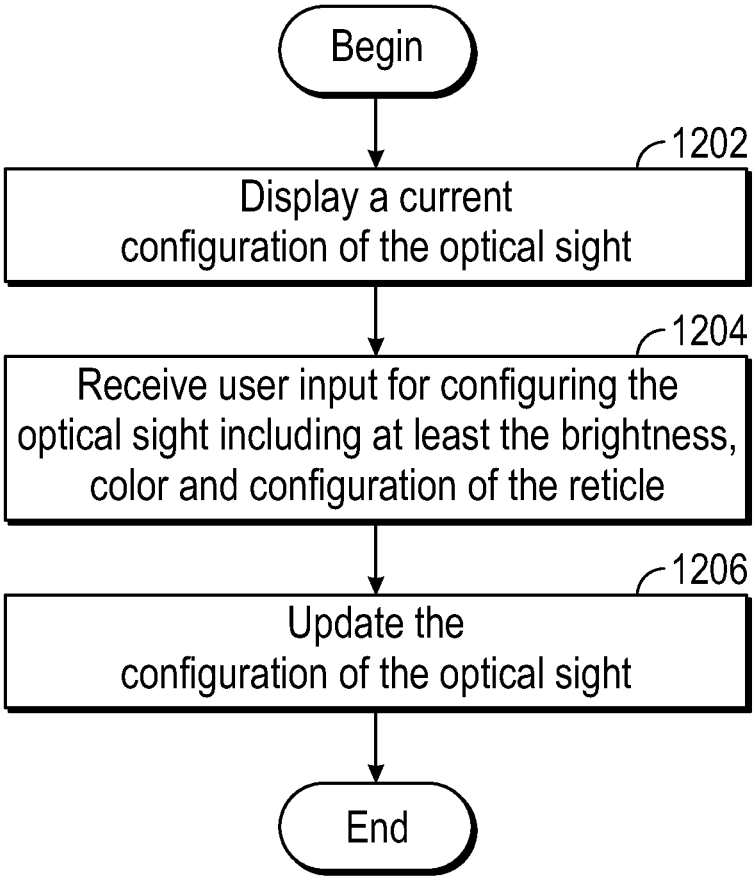
FIG. 12 is a flowchart of a process for configuring an optical sight in accordance with an illustrative embodiment.

FIG. 12 is a flowchart of a process for configuring an optical sight in accordance with an illustrative embodiment. The process of FIG. 12 may be performed by a smart optical sight is herein described. The optical sight may function independently or may communicate with one or more electronic devices, such as a smart phone. The optical sight may communicate utilizing a wireless connection and/or signal or may communicate utilizing a physical connection (e.g., cable, wire, etc.). Various data or information may be communicated or otherwise presented to the user utilizing the optical sight or a user interface of a program/application executed by the computing or communications device in communication with the optical sight. In one embodiment, the process may begin by displaying a current configuration of the optical sight (step 1202). For example, the optical sight may present the reticle as well as any projected graphics utilizing the applicable color, brightness, line width, and other settings. The user interface may also be utilized to present this same information.

Next, the system receives user input for configuring the optical sight including at least the brightness, color, and configuration of the reticle (step 1204). In one embodiment, the user interface of the optical sight may be utilized to receive configuration into nation (e.g., buttons, dials, screws, touch screens, sensors, etc.). In another embodiment, the graphical user interface of a mobile sight application may include sort buttons, menus, icons, scroll wheels, tabs, or other elements for receiving the user input. The user input may represent changes, feedback, or selections that are implemented in hardware, software, firmware, or a combination thereof. In another embodiment, the user may select pre-configured selections or modes. These pre-configured selections may represent reticle information provided by default by the optical sight or user program selections and configurations. For example, the selections may indicate a red reticle is utilized with a minimum line width with a level 8 (1-10 scale from dimmest to brightest) light intensity.

Next, the system updates the configuration of the optical sight (step 1206). The updates may be performed in real-time as made, sequentially, or once the optical sight is reset, restarted, or completely updated. In another embodiment, the optical sight may be utilized to compensate for distance, wind, ambient lighting conditions, and other user, sight, or environmental conditions.

Figure 13:
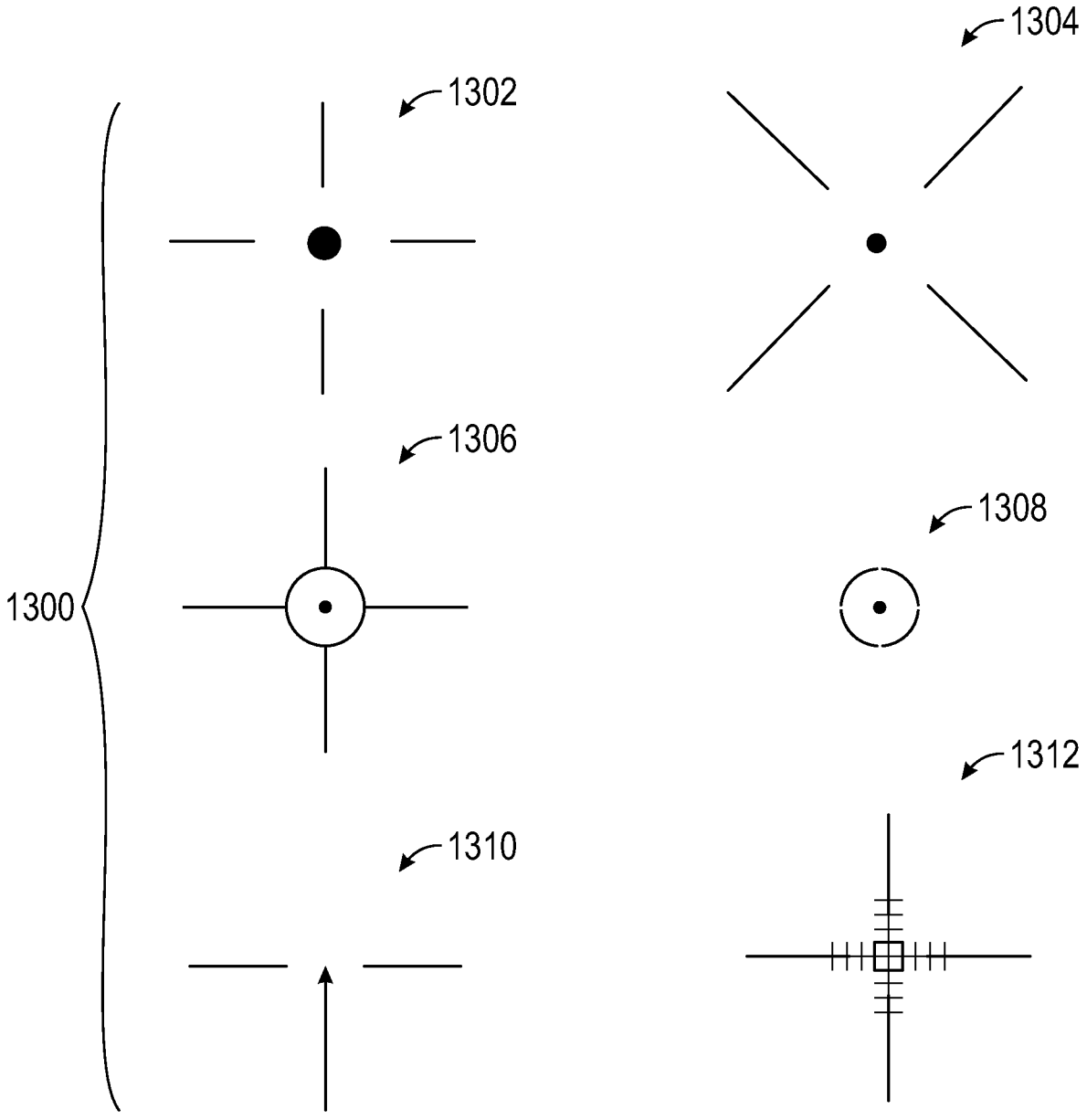
FIG. 13 is a pictorial representation of reticles that may be displayed by the optical sight in accordance with an illustrative embodiment.

FIG. 13 is a pictorial representation of reticles 1300 that may be displayed by the optical sight in accordance with an illustrative embodiment. The reticles 1302, 1304, 1306, 1308 (altogether reticles 1300) represent one or more aiming, targeting, or shooting tools that may be utilized to aim the optical sight and associated weapon.

The reticles 1300 may include various dots, circles, lines, shapes, graphics, icons, read outs, text, markings, indicators, or so forth. The reticles 1300 may include fixed components (e.g., aiming system) as well as dynamic components (e.g., battery status, distance indicator, ambient light indicator, target identification, shots remaining, optical sight angles, etc.). The dynamic components may represent data, information, and graphics that may be displayed, projected, communicated, or otherwise presented to the user based on one or more sensors, components, or systems of the optical sight. The reticles 1300 may be configured along with the fixed components and the dynamic components. Portions of the reticles 1300 may be combined to reach a desired configuration. As previously disclosed, the reticles 1300 may be provided as default options, may be selected from a menu, or may user configured for utilization by the optical sight. The reticles 1300 may be pre-loaded, custom created, uploaded, or otherwise made available to the optical sight. The optical sight may include a user interface for selecting and/or configuring one of the reticles 1300. In one embodiment, different reticles 1300 may be combined, merged, or displayed, such as a dot and cross hairs. As previously described the light source, projector, filters, or other components may function alone or in combination to display, project, filter, emit, or otherwise generate the reticles 1300. The various components of the reticles 1300 may also be customized, adjusted, changed, configured, or programmed. For example, the color, size (e.g., diameter, line width), shape, angles, position, and other parameters, settings, and conditions of one or more portions/components of the reticles 1300 may be adjusted, changed, configured, or programmed.

Figure 14:
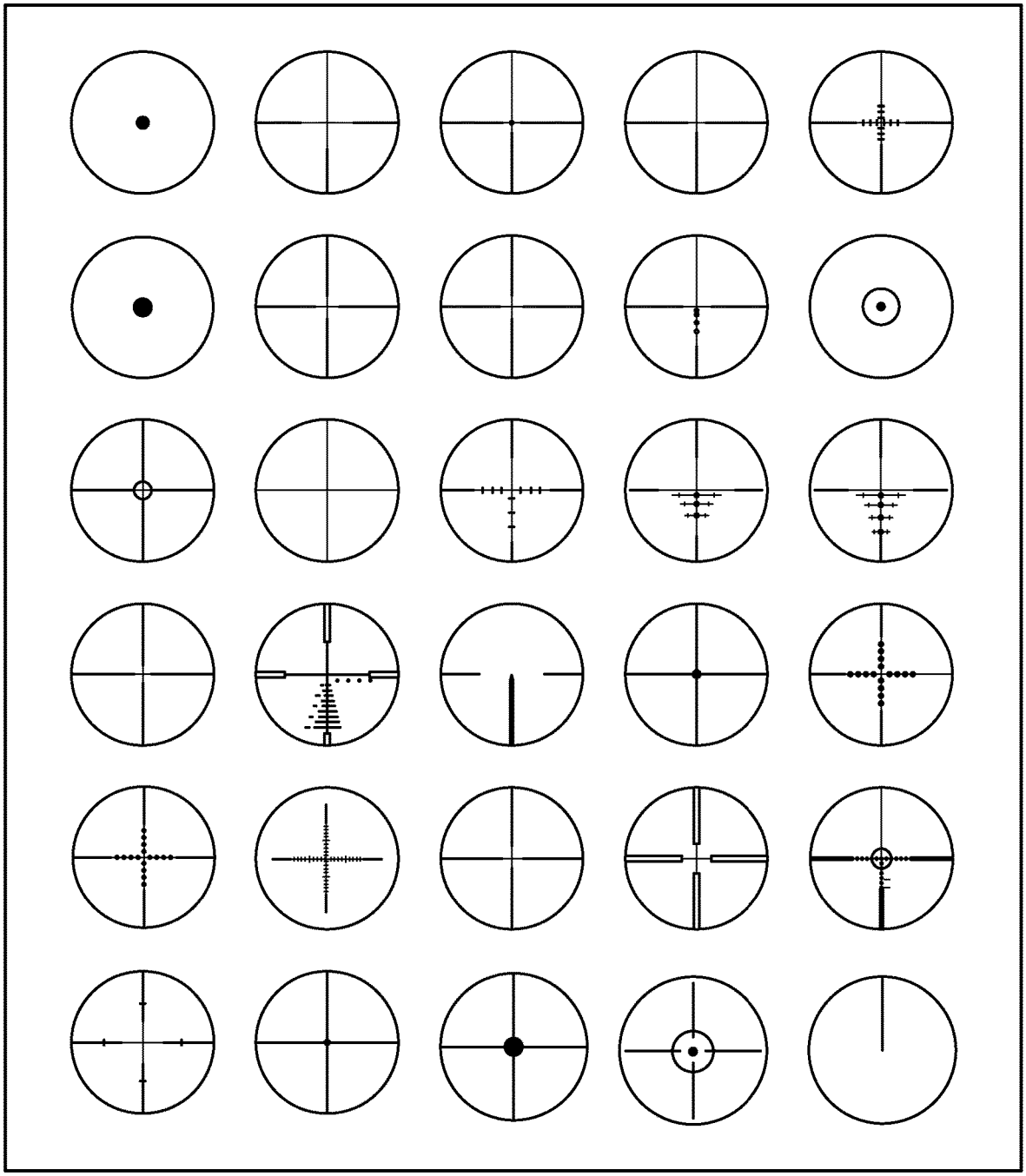
FIG. 14 is a pictorial representation of reticles in accordance with an illustrative embodiment.

FIG. 14 is a pictorial representation of reticles 1400 in accordance with an illustrative embodiment. The reticles 1400 may represent any number aiming systems that may be implemented by the optical sight. The reticles 1400 may be presented, projected, reflected or otherwise displayed to the user in one or more colors. In some embodiments, all or portions of the reticles 1400 may be displayed in red, green, blue, yellow, purple, black, white, or other colors. Fluorescent colors or variations may also be utilized. As previously noted, the optical sight may be preloaded with the reticles or the user may custom combine different optical elements, colors, or features into a unique reticle. In another embodiment, reticles may be uploaded utilizing a memory card (e.g., micro SD card).

For example, the reticle may include a dot (i.e., 3 MOA—milliradian or minute of angle, 10 MOA, etc.), a German #4 reticle, a dot reticle, a Mil-plex reticle, a Vplex, truplex reticle, a 30/30 IR cross reticle, a bullet drop compensation (BDC) reticle, a circle dot, a circlex easy shot reticle, a crosshair reticle, a deadhold BDC reticle, a DOA 250 reticle, a DOA 600 reticle, a firefly reticle, a G2 DMR reticle, a German #1 reticle, a target dot, a Mil-dot IR reticle, a Mil-Dot reticle, a MOA reticle, a multix reticle, a 30/30 reticle, a special purpose reticle, a tactical milling reticle, a target dot reticle, an original reticle, a Christmas tree reticle, a star reticle, a cross, a bullseye, a duplex reticle, a fine duplex, a fine crosshair, circle, a range finding reticle, a modern range finding reticle, a SVD-type, a Boone & crocket reticle, a Leuopold reticle, or other similar reticle.

Figure 15:
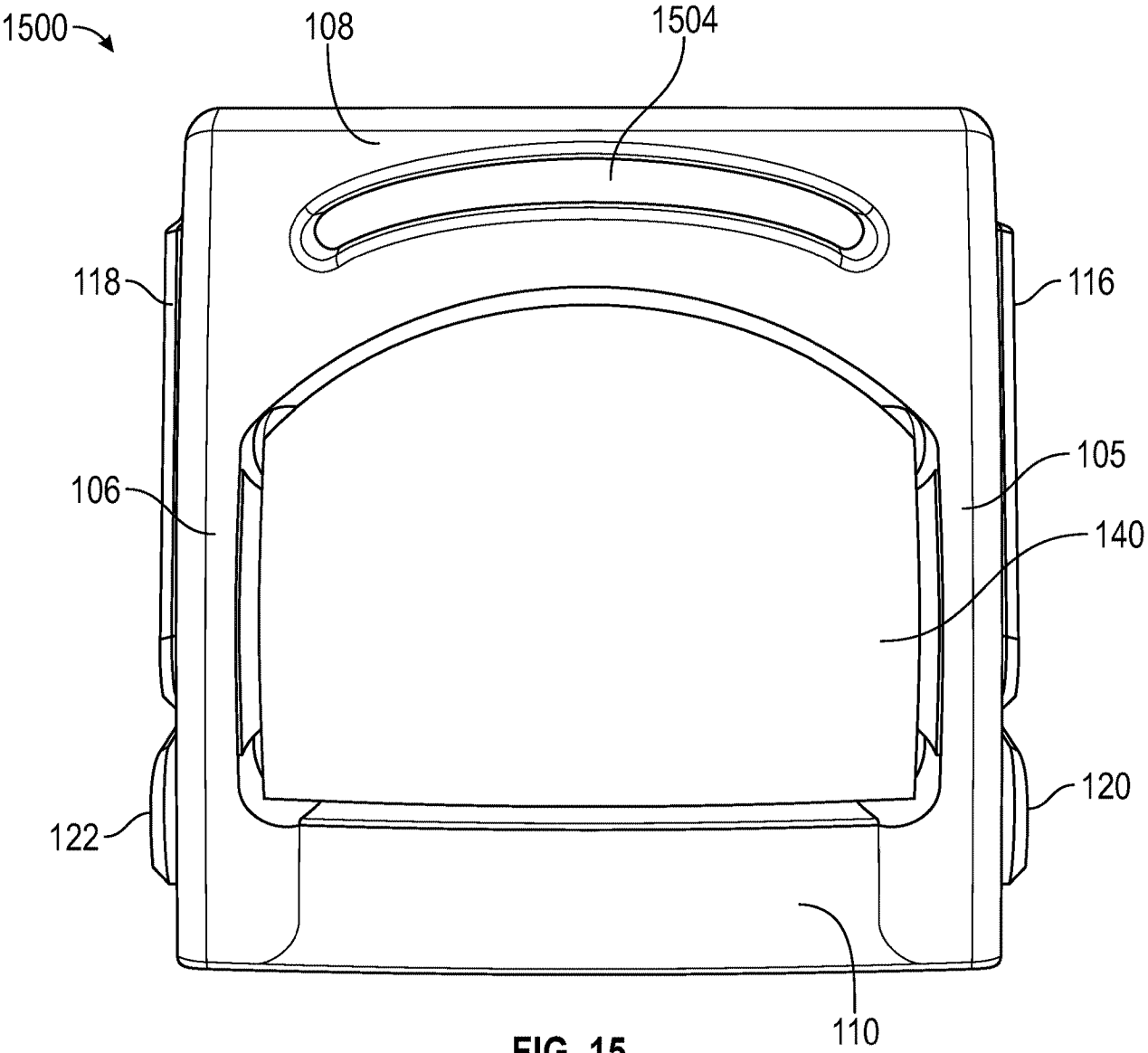
FIG. 15 is another pictorial representation of in optical sight in accordance with an illustrative embodiment.

FIG. 15 is another pictorial representation of an optical sight in accordance with an illustrative embodiment. As shown the optical sight 1600 may include a top opening 1504 that matches the curve of the optics 140. The curved of the top opening 1504 may match the curve of the optics 140 (e.g., one or more lenses) to better protect the optics 140. The top opening 1504 may also be curved for aesthetics. The top support 108 may also be rounded. Curved versions of the top opening 1504 and top support 108 may minimize the materials utilized and provide additional ways that the forces imparted on the optical sight may be deflected or absorbed without breaking, dislocating, or damaging the optics 140.

In another embodiment, the optical sight may include one or more filters, lenses, or replaceable light sources or projectors for configuring the reticle acid visually displayed information. The user made or remove these physical components to change the reticle and other displayed components. As a result, the optical sight may be configured utilizing modular units or components.

The previous detailed description is of a small number of embodiments for implementing the invention and is not intended to be limiting in scope. The following claim set forth a number of the embodiments of the invention disclosed with greater particularity.

What is claimed:

1. An optical sight comprising:

a housing including a base, a first support, a second support, and a top support, the first support and the second support extend from opposing sides of the base, the top support extends between the first support and the second support, the top support extends over an optical element and includes a surface adjacent the optical element, the top support defines one or more openings extending above the optical element, a side opening is defined in one or more of the first support and the second support;

the optical element is supported by the housing between the base, the first support, the top support, and the second support; and a reticle is displayed on the optical element.

2. The optical sight of claim 1, further comprising:
the reticle is projected on the optical element including one or more lenses.

3. The optical sight of claim 1, wherein the side opening includes a shock absorber.

4. The optical sight of claim 1, wherein the side opening defines an isosceles trapezium or an isosceles trapezoid.

5. The optical sight of claim 1, wherein the one or more openings in the top support is a rounded rectangle.

6. The optical sight of claim 1, wherein the one or more openings follows a curvature of the optical element including at least a lens below the top opening.

7. The optical sight of claim 1, wherein the optical sight is a reflex sight configured to be mounted to at least a handgun.

8. The optical sight of claim 1, wherein the base includes a plurality of adjustments for one or more light sources projecting at least the reticle, and wherein the plurality of adjustments are positioned below side openings defined in the first support and the second support.

9. The optical sight of claim 1, wherein the side opening and the top opening are filled with dampeners.

10. An optical sight, comprising:
a housing including a base;
supports integrated with and extending from both sides of the base, each of the supports defines a side opening including a shock absorber,
a top support integrated with and extending between the supports, the top support defines a top opening extending above at least a lens; and
optics enclosed within the housing including at least the lens.

11. The optical sight of claim 10, wherein the top opening further includes a shock absorber.

12. The optical sight of claim 10, wherein the side openings and the top openings do not include any electronics.

13. The optical sight of claim 10, wherein adjustments for electronics associated with the optics are integrated in the base.

14. The optical sight of claim 10, wherein the adjustments are buttons for adjusting the brightness of a reticle.

15. The optical sight of claim 10, wherein the base includes a removable battery compartment for replacing one or more batteries of the optical sight.

16. The optical sight of claim 10, wherein the side openings defined in the supports represent an isosceles trapezium.

17. An optical sight, comprising:
a housing including at least a base, an upwardly extending portion, and a top portion, the upwardly extending portion extends from the base, the upwardly extending portion includes an opening receiving an optical element and a top portion extending over the optical element, the top portion defines at least one opening in said housing and above said optical element, the at least one opening includes a shock absorber;
the optical element supported by the housing within the upwardly extending portion; and
a reticle displayed on the optical element utilizing at least one or more light sources and one or more lenses.

18. The optical sight of claim 17, wherein the optical sight is a reflex sight, wherein the at least one opening is at least 2 mm in height.

19. The optical sight of claim 17, wherein the at least one opening extends above at least 70% of a width of the optical element.

20. The optical sight of claim 17, wherein the at least one opening is a plurality of openings defined within the top portion.

* * * * *